US010287055B2

(12) United States Patent
Barattin et al.

(10) Patent No.: US 10,287,055 B2
(45) Date of Patent: May 14, 2019

(54) SOFT-SIDED INSULATED CONTAINER WITH WORK SURFACE

(71) Applicants: Alexander Barattin, Toronto (CA); Marlowe Baca, Berwyn, IL (US)

(72) Inventors: Alexander Barattin, Toronto (CA); Marlowe Baca, Berwyn, IL (US)

(73) Assignee: CALIFORNIA INNOVATIONS INC. (CA)

( * ) Notice: Subject to any disclaimer, the term of this patent is extended or adjusted under 35 U.S.C. 154(b) by 50 days.

(21) Appl. No.: 14/793,063

(22) Filed: Jul. 7, 2015

(65) Prior Publication Data

US 2017/0008688 A1 Jan. 12, 2017

(51) Int. Cl.

| | |
|---|---|
| ***B65D 81/38*** | (2006.01) |
| ***B65D 43/16*** | (2006.01) |
| ***A45C 13/02*** | (2006.01) |
| ***B65D 21/08*** | (2006.01) |
| ***A45C 13/00*** | (2006.01) |
| ***A45C 13/26*** | (2006.01) |
| ***A47G 23/03*** | (2006.01) |
| ***B65D 25/24*** | (2006.01) |
| ***A45C 11/20*** | (2006.01) |
| ***A45C 7/00*** | (2006.01) |

(52) U.S. Cl.

CPC ..... *B65D 21/086* (2013.01); *A45C 7/0077* (2013.01); *A45C 11/20* (2013.01); *A45C 13/005* (2013.01); *A45C 13/02* (2013.01)

(58) Field of Classification Search

CPC ..... A45C 11/20; A45C 13/005; A45C 13/02; A45C 7/0077; B65D 81/3813; B65D 21/086; B65D 25/24; B65D 43/16; B65D 81/3888; B65D 81/38; B65D 25/14; B65D 25/28; A47G 23/03; A45F 3/02

USPC ..... 220/592.2; 62/457.4

See application file for complete search history.

(56) References Cited

U.S. PATENT DOCUMENTS

| | | | |
|---|---|---|---|
| 294,622 | A | 3/1884 | Honingeb |
| 1,627,344 | A | 5/1927 | Scott |
| 1,696,138 | A | 12/1928 | Day et al. |
| 1,871,153 | A | 8/1932 | Buchanan |
| 1,928,976 | A | 10/1933 | Grasso |
| 2,087,966 | A | 7/1937 | Clark |
| 2,181,074 | A | 11/1939 | Scott |
| 2,485,643 | A | 10/1949 | Norquist |

(Continued)

FOREIGN PATENT DOCUMENTS

| | | |
|---|---|---|
| DE | 10202530 | 8/2003 |

*Primary Examiner* — Andrew D Perreault
(74) *Attorney, Agent, or Firm* — Ostrolenk Faber LLP

(57) ABSTRACT

A soft-sided insulated container assembly has a generally box-shaped form, having a main body and a lid. The lid is joined to the main body of the box by a hinge. The front face of the unit may have a mid or partial height work surface. The work surface may be movable between a collapsed or retracted position, and a raised or deployed position. The work surface may be formed in a substantially rigid molded stiffener member, and may be divided into sub-regions with raised retainers to discourage sliding of objects where not precisely level. The container assembly may include a rigid internal liner with which the lid may mate zipperlessly. The mating portion of the lid may be formed in the same rigid member as the work surface. The work surface may be located at a depressed height relative to the main container opening.

28 Claims, 25 Drawing Sheets

(56) References Cited

U.S. PATENT DOCUMENTS

| | | | |
|---|---|---|---|
| 2,496,296 | A | 2/1950 | Frederick |
| 2,619,801 | A | 12/1952 | Evans |
| 2,827,096 | A | 3/1958 | Hinson |
| 2,850,391 | A | 9/1958 | Gunsberg |
| RE25,826 | E | 2/1965 | Ward |
| 3,759,356 | A | 9/1973 | Bostick et al. |
| 4,343,158 | A | 8/1982 | Campbell et al. |
| 4,506,769 | A | 3/1985 | Franco et al. |
| 4,517,815 | A | 5/1985 | Basso |
| D284,715 | S | 7/1986 | Jacober et al. |
| 4,655,052 | A | 4/1987 | Garcia et al. |
| 4,673,113 | A | 6/1987 | Calton |
| 4,706,856 | A | 11/1987 | Jacober |
| 4,767,039 | A | 8/1988 | Jacober |
| 4,889,257 | A | 12/1989 | Steffes |
| 4,892,226 | A | 1/1990 | Abtahi et al. |
| D312,530 | S | 12/1990 | Gallen et al. |
| D315,827 | S | 4/1991 | King |
| D316,012 | S | 4/1991 | Christopher |
| 5,064,088 | A | 11/1991 | Steffes |
| D328,550 | S | 8/1992 | Mogil et al. |
| D340,387 | S | 10/1993 | Melk |
| D340,621 | S | 10/1993 | Melk |
| D340,840 | S | 11/1993 | Melk |
| 5,337,911 | A | 8/1994 | Holub |
| 5,354,131 | A | 10/1994 | Mogil et al. |
| 5,403,095 | A | 4/1995 | Melk et al. |
| D368,387 | S | 4/1996 | Bureau |
| 5,505,307 | A | 4/1996 | Shink |
| D371,052 | S | 6/1996 | Melk |
| 5,524,761 | A | 6/1996 | Wayman |
| D373,514 | S | 9/1996 | Melk |
| D373,515 | S | 9/1996 | Melk |
| D382,771 | S | 8/1997 | Mogil |
| D382,772 | S | 8/1997 | Mogil |
| D387,249 | S | 12/1997 | Mogil |
| D391,121 | S | 2/1998 | Melk |
| D394,552 | S | 5/1998 | Melk |
| D408,225 | S | 4/1999 | Hodosh |
| 5,904,230 | A | 5/1999 | Peterson |
| 5,924,303 | A | 7/1999 | Hodosh |
| D419,770 | S | 2/2000 | Mogil |
| D419,830 | S | 2/2000 | Birutis et al. |
| 6,092,661 | A | 7/2000 | Mogil |
| 6,105,844 | A | 8/2000 | Walters et al. |
| 6,234,677 | B1 | 5/2001 | Mogil |
| 6,238,091 | B1 | 5/2001 | Mogil |
| 6,247,328 | B1 | 6/2001 | Mogil |
| D445,307 | S | 7/2001 | Fickle |
| D446,937 | S | 8/2001 | Mogil |
| 6,296,165 | B1 | 10/2001 | Mears |
| D452,075 | S | 12/2001 | Mogil |
| 6,439,389 | B1 | 8/2002 | Mogil |
| 6,513,661 | B1 | 2/2003 | Mogil |
| 6,582,124 | B2 | 6/2003 | Mogil |
| 6,821,019 | B2 | 11/2004 | Mogil |
| 7,162,890 | B2 | 1/2007 | Mogil et al. |
| 7,669,436 | B2 | 3/2010 | Mogil et al. |
| 7,841,207 | B2 | 11/2010 | Mogil et al. |
| 8,043,004 | B2 | 10/2011 | Mogil |
| 8,096,442 | B2 | 1/2012 | Ramundi |
| 8,348,510 | B2 * | 1/2013 | Mogil ..... A45C 5/02 383/105 |
| 2001/0039807 | A1 | 11/2001 | Mogil |
| 2005/0263528 | A1 * | 12/2005 | Maldonado ..... A45C 11/20 220/592.2 |
| 2005/0279123 | A1 * | 12/2005 | Maldonado ..... A45C 5/02 62/457.7 |
| 2006/0196218 | A1 * | 9/2006 | Mogil ..... A45C 7/0077 62/457.4 |
| 2013/0341338 | A1 * | 12/2013 | Mitchell ..... A45C 11/20 220/592.2 |

* cited by examiner

SOFT-SIDED INSULATED CONTAINER WITH WORK SURFACE

FIELD OF THE INVENTION

This invention relates to the field of insulated portable containers.

BACKGROUND OF THE INVENTION

Soft-sided insulated containers may be used to transport articles that may best be served cool, such as beverages or salads, or warm, such as appetizers, hot dogs, and so on. Such containers are also used to carry liquids, whether hot liquids, such as soup containers, coffee or tea, or cold liquids such as beer, soft drinks, or other carbonated beverages, juices and milk. The containers are typically made in a generally cube-like shape, whether of sides are of equal length or not, having a base, four upstanding walls, and a top. The top wall is often a lid which opens to permit articles to be placed in, or retrieved from, the container.

SUMMARY OF THE INVENTION

In an aspect of the invention there is a soft-sided insulated container, or container assembly. It has a first container portion. The first container portion has a soft-sided insulated wall structure defining an insulated chamber therewithin. The insulated chamber has an upwardly facing opening. The first container portion has a lid mounted thereto. The lid is movable to govern access to the chamber. The lid is mounted to a rearward portion the soft-sided insulated wall structure. A substantially rigid work surface is mounted to a forward region of the soft-sided insulated wall structure distant from the rearward portion. The substantially rigid work surface is positioned clear of the opening. The substantially rigid work surface is movable between a first position and a second position. In the first position the substantially rigid work surface extends forwardly of the first container portion and faces predominantly upwardly to provide a support interface upon which to place objects. In the second position the work surface is in a storage position.

In a feature of that aspect of the invention, the container also has a second container portion mounted forwardly of the first container portion, and the substantially rigid work surface defines an upper portion of the second container portion. In another feature, the substantially rigid member includes at least one drink-holder well. In another feature, the first container portion is movable from an expanded position to a collapsed position in which at least a part of the first container portion is collapsed. In another feature, in the collapsed position of the first container portion the lid conceals at least a portion of the substantially rigid work surface. In still another feature, the substantially rigid work surface is stepped downwardly relative to the opening. In a further additional feature, the substantially rigid work surface has a drink well. In a still further feature, the drink well has an opening. The opening has a major dimension. The drink well has a depth. The depth is at least half as great as the major dimension. The substantially rigid work surface, in the first position thereof, is stepped downwardly of the opening of the first container portion by a step distance. The step distance and the depth is, in sum, more than twice as great as the major dimension of the well.

In another feature, in the first position, the substantially rigid work surface extends forwardly of the first container portion a first distance, and is stepped downwardly of the opening a second distance, the second distance being at least one third as great as the first distance. In another feature, in the first position, the substantially rigid work surface is angled toward the first container portion.

In another feature, the soft-sided insulated wall structure of claims first portion has a bottom wall and a four-sided peripheral wall standing predominantly upwardly from the bottom wall whereby to form an open-topped five-sided substantially box-shaped enclosure. The lid defines a sixth side of the enclosure, and has a four-sided shape corresponding to the four-sided peripheral wall. A first side of the four-sided peripheral wall defines a rear side of the first portion. The rear side has an upper margin distant from the bottom wall. A second side of the four-sided peripheral walls defines a front side of the first portion, the front side of the first portion being opposite the rear side. The lid is hingedly mounted to the upper margin of the rear side. A second container portion is mounted to the front side of the first portion. The substantially rigid work surface defining an upper panel of the second container portion. The second container portion is collapsible. The substantially rigid work surface is hingedly connected to the front side of the first container portion along a margin that is stepped downwardly relative to the opening of the first container portion. The first substantially rigid work surface having a retainer for discouraging motion of objects relative to the substantially rigid work surface.

In another aspect of the invention there is a soft-sided insulated container. It has a first container portion, the first container portion having a soft-sided insulated wall structure defining an insulated chamber therewithin. The insulated chamber has an upwardly facing opening. The first container portion has a lid mounted thereto. The lid is movable to govern access to the chamber. The lid is mounted to a rearward margin the soft-sided insulated wall structure. A substantially rigid work surface mounted to a forward region of the soft-sided insulated wall structure distant from the rearward margin. The substantially rigid work surface is positioned clear of the opening. The substantially rigid work surface extending forwardly of the first container portion and facing predominantly upwardly to provide a support interface upon which to place objects. The substantially rigid work surface is located downwardly shy of the opening.

In a feature of that aspect, the substantially rigid work surface is movable between a deployed position for supporting objects, and a storage position. In another feature, the container includes a second container portion mounted forwardly of the first container portion, the second container portion defining a second chamber in which to receive objects. The substantially rigid work surface defining an upper wall of the second container portion. In a further feature, the second container portion is collapsible and the second position of the work surface corresponds to the collapsed position of the second container portion. In a yet further feature, the first container portion is collapsible. In still another feature, the container includes a second container portion mounted forwardly of the first container portion, the second container portion defining a second chamber in which to receive objects. In another feature, the substantially rigid work surface defines an upper wall of the second container portion. In another feature, the second container portion is collapsible and the second position of the work surface corresponds to the collapsed position of the second container portion. In another feature, the collapsed position of the first portion and of the second portion the lid of the first portion at least partially conceals the substantially rigid work surface.

In another feature, the substantially rigid work surface has a drink holder well defined therein. In a further feature, the substantially rigid surface is stepped downwardly from the opening by a first distance; the drink holder well has a depth of a second distance. The sum of the first distance and the second distance is at least four inches. The first distance is at least half as great as the second distance. In a still yet further feature, the soft-sided insulated wall structure first portion has a bottom wall and a four-sided peripheral wall standing predominantly upwardly from the bottom wall whereby to form an open-topped five-sided substantially box-shaped enclosure. The lid defines a sixth side of the enclosure, and has a four-sided shape corresponding to the four-sided peripheral wall. A first side of the four-sided peripheral wall defines a rear side of the first portion. The rear side has an upper margin distant from the bottom wall. A second side of the four-sided peripheral walls defines a front side of the first portion, the front side of the first portion being opposite the rear side. The lid is hingedly mounted to the upper margin of the rear side. A second container portion in which to receive objects is mounted to the front side of the first portion. The substantially rigid work surface defining an upper panel of the second container portion. The second container portion is collapsible. The substantially rigid work surface is hingedly connected to the front side of the first container portion along a margin that is stepped downwardly relative to the opening of the first container portion. The first substantially rigid work surface has a retainer for discouraging motion of objects relative to the substantially rigid work surface.

In another feature, the substantially rigid work surface is movable between a deployed position for supporting objects, and a storage position. The container includes a second container portion mounted forwardly of the first container portion, the second container portion defining a second chamber in which to receive objects. The substantially rigid work surface defining an upper wall of the second container portion. The second container portion is collapsible and the second position of the work surface corresponds to the collapsed position of the second container portion. The retainer is a drink holder. The drink holder includes a well that extends into the second container portion. The substantially rigid surface is stepped downwardly from the opening by a first distance. The drink holder well has a depth of a second distance. The first distance is at least half as great as the second distance.

In another feature, the substantially rigid work surface has the form of a movable table top. In a further feature, the table top has support structure that includes one of (a) a folding leg; (b) a telescoping leg; and (c) a hinged table leaf support. In a still further feature, the table top has a support spring biased to the first position of the substantially rigid work surface. In yet another feature, the table top is supported by a pair of spring-loaded folding struts that are biased to the first position of the substantially rigid work surface.

In another feature, the work surface is a first substantially rigid work surface, and the container has a second substantially rigid work surface. The second substantially rigid work surface is movable between a deployed position and a storage position. In a further feature, the second substantially rigid work surface is mounted rearwardly of the lid. In an alternate feature, the second substantially rigid work surface is mounted to a side of the container that is other than rearwardly of the lid. In still yet another further feature, the second substantially rigid work surface defines an upper panel of a collapsible storage enclosure.

In another aspect of the invention there is a soft-sided insulated container with a rearwardly hinged lid and a forwardly mounted flip-up table top.

BRIEF DESCRIPTION OF THE DRAWINGS

These aspects and other features of the invention may be understood with the aid of the following illustrations of a number of exemplary, and non-limiting, embodiments of the principles of the invention in which.

DETAILED DESCRIPTION

Figure 1A:
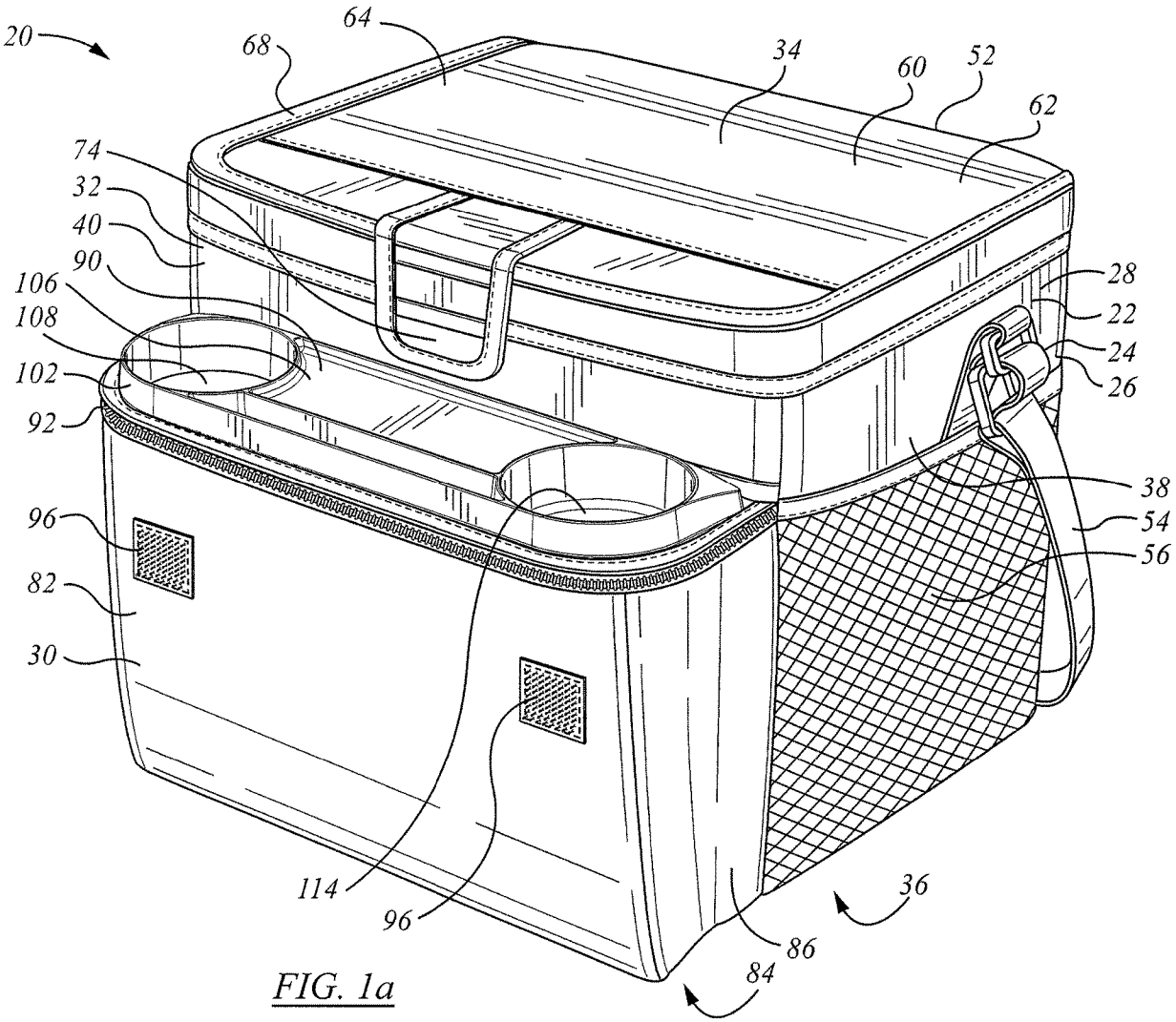
FIG. 1*a* shows a perspective view of a container assembly according to an aspect and features of the invention described herein, viewed from in front, to the left, and above.
Figure 1B:
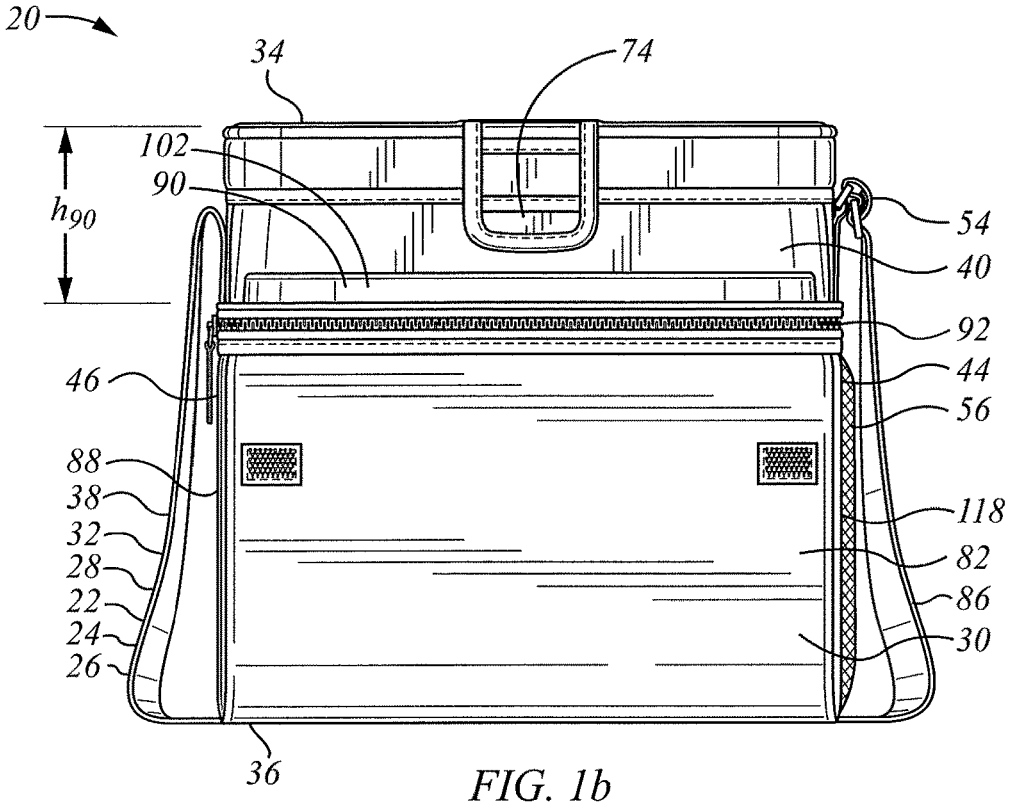
FIG. 1*b* shows a front view of the container assembly of FIG. 1*a;*
Figure 1C:
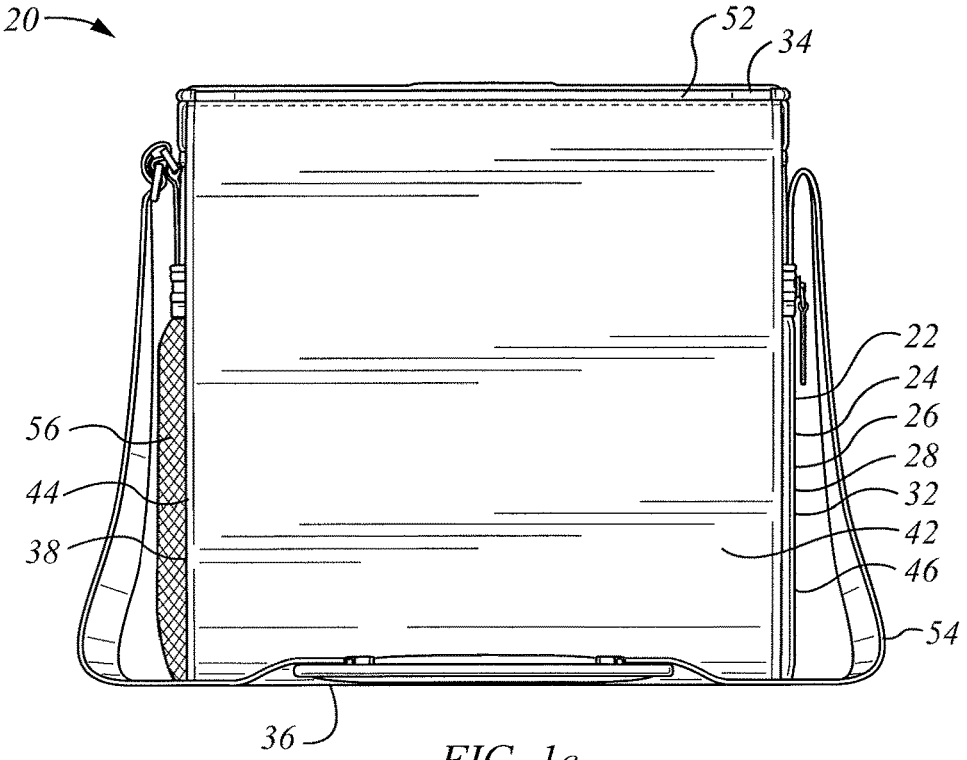
FIG. 1*c* shows a rear view of the container assembly of FIG. 1*a;*
Figure 1E:
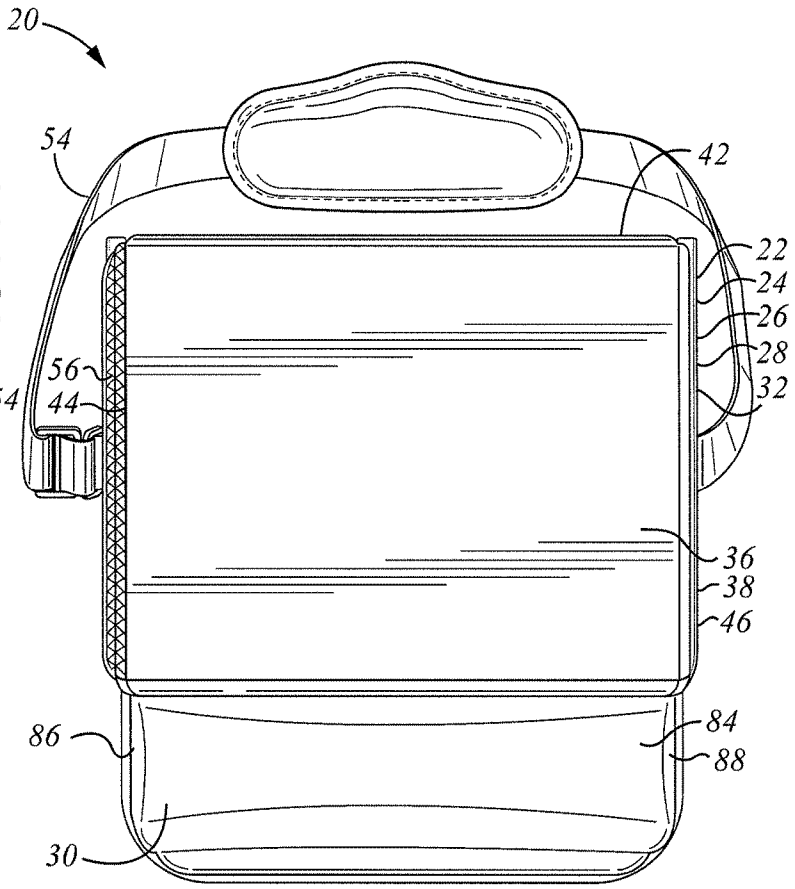
FIG. 1*e* shoes a bottom view of the container assembly of FIG. 1*a;*
Figure 1D:
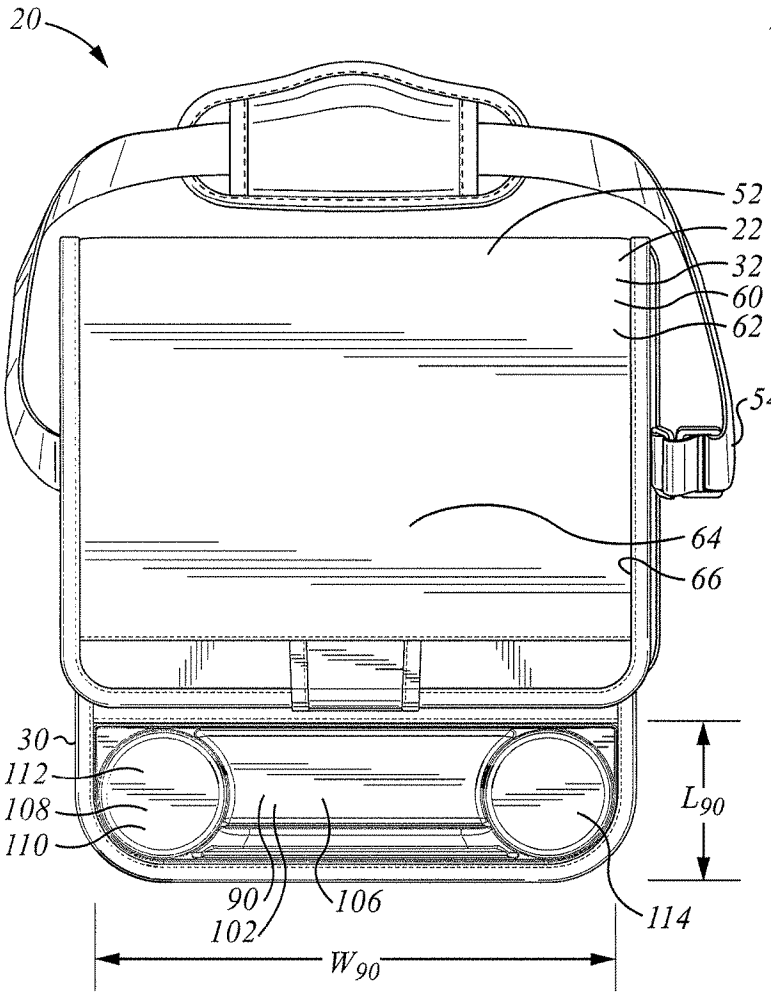
FIG. 1*d* shows a top view of the container assembly of FIG. 1*a;*
Figure 1F:
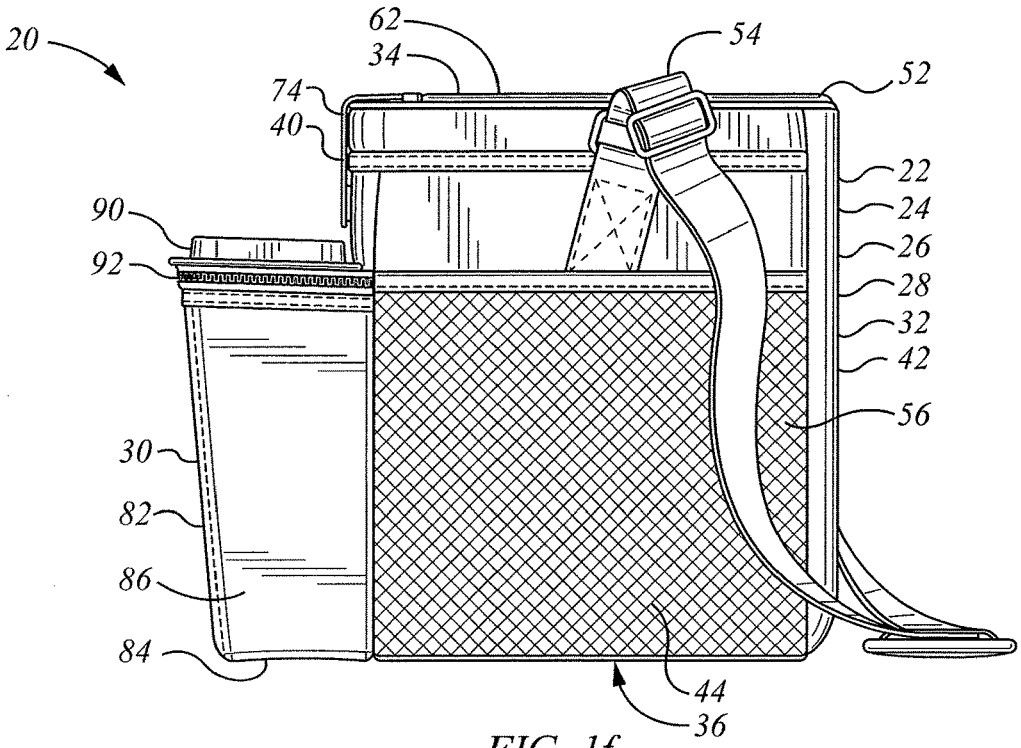
FIG. 1*f* shows a right-hand view of the container assembly of FIG. 1*a;*
Figure 1G:
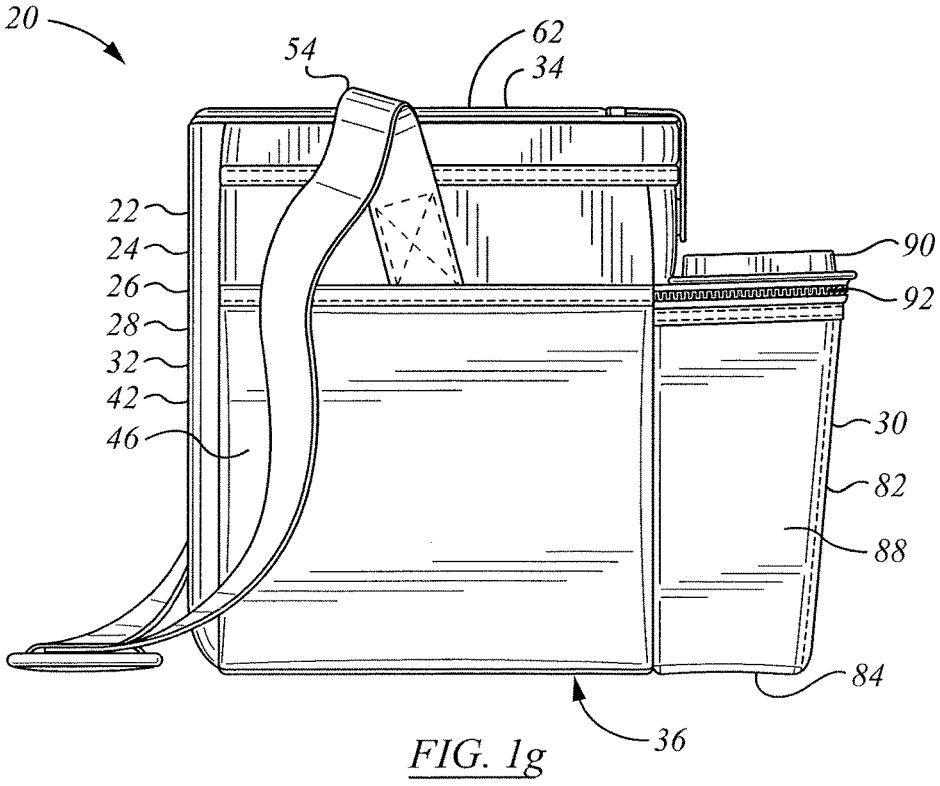
FIG. 1*g* shows a left-hand view of the container assembly of FIG. 1*a;*
Figure 2A:
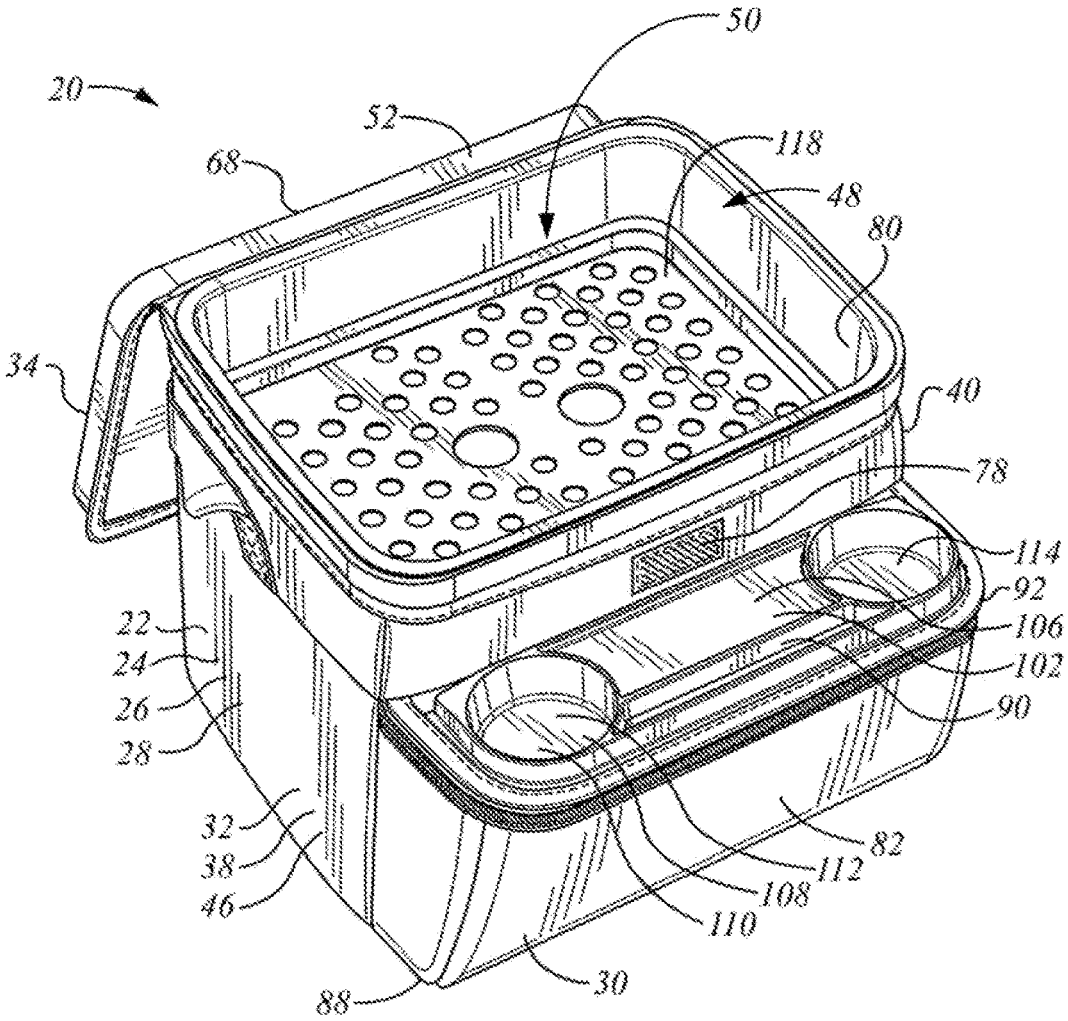
FIG. 2*a* shows a perspective view of the container assembly of FIG. 1*a* in an open condition.
Figure 2B:
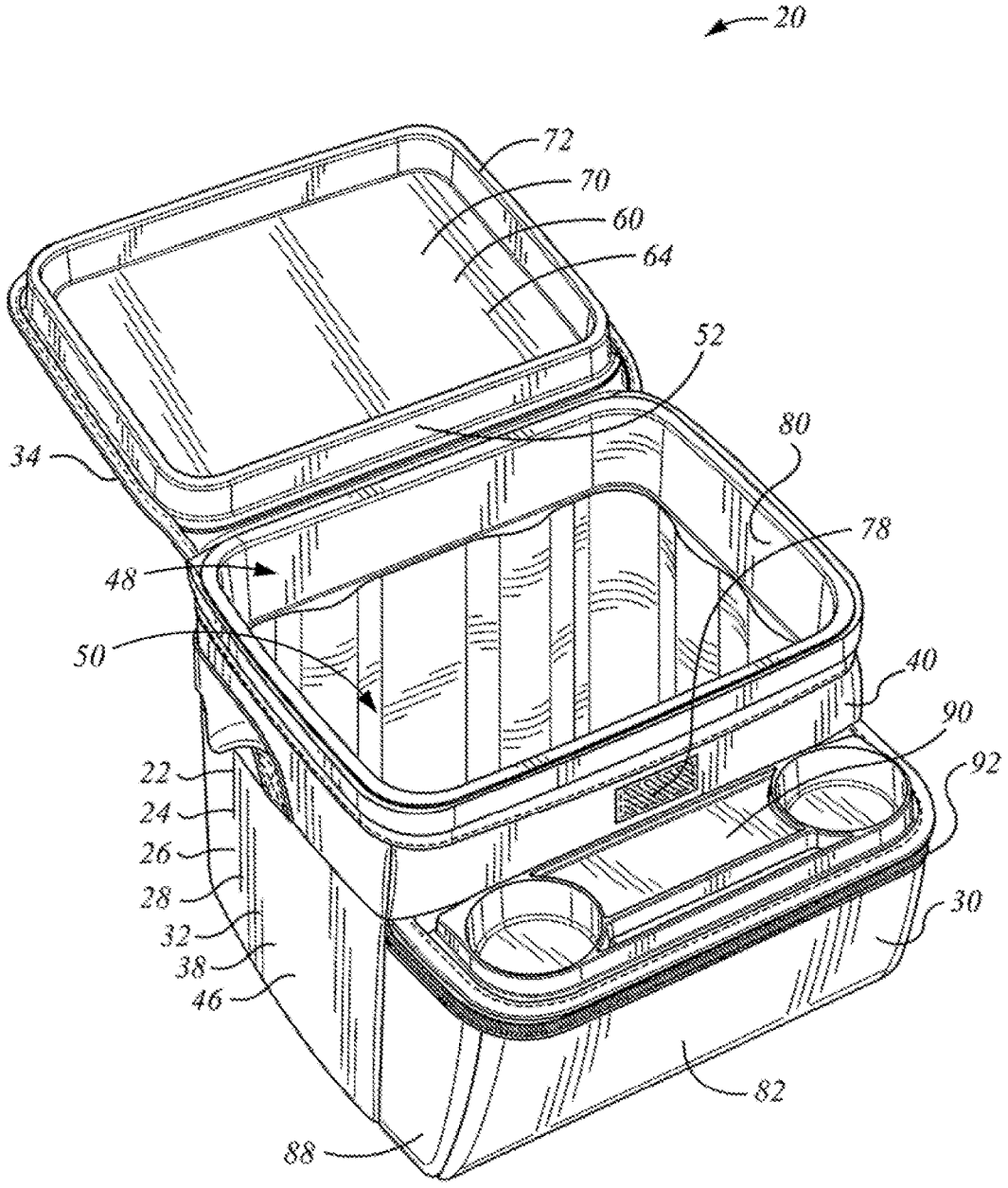
FIG. 2*b* shows the container assembly of FIG. 2*a* with internal shelving removed and lid held substantially level.

The description that follows, and the embodiments described therein, are provided by way of illustration of an example, or examples of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order to more clearly depict certain features of the invention. In the description and drawings herein, reference may be made to a Cartesian co-ordinate system in which the vertical direction, or z-axis, extends in an up and down orientation from bottom to top. The x-axis extends in the shorter dimension of the container assembly, when fully expanded, running in the front-to-back direction. The y-axis extends cross-wise horizontally relative to the x-axis, running in the side-to-side direction. Unless noted otherwise, the terms "inside" and "outside", "inwardly" and "outwardly", refer to location or orientation relative to the enclosed spaces of the first and second portions of the container assembly, as may be.

The term "insulated" or "insulated wall structure" may be used in this description. It is intended to pertain to walls having a layer of thermal insulation. Typically such walls have an inner surface or lining or web, an outer surface or lining or web, and a layer of insulation material captured between the inner and outer surfaces. The outside layer may be a wear-resistant or scuff resistant material. Thin single membranes or sheets of web material, such as woven high density Nylon (t.m.), or vinyl (t.m.), or polyester, or leather, or paper, are not of themselves intended to fall within the meaning of the term "insulated" as used herein unless they have been treated or formed in an manner deliberately to enhance thermal insulating properties.

A soft-sided insulated structure is one in which the insulated panels are flexible panels, typically in the form of fabric or plastic sheets with insulation inside. In some embodiments they may be like quilted panels. In some embodiments, a substantially rigid liner is mounted inside the soft-sided insulated structure to stiffen it. The liner is typically removable, although not always. In some embodiments stiffened battens may be mounted to the soft-sided panels. The battens may be removable, or may be permanent. A soft-sided insulated structure may be understood as being in contrast to a hard-sided insulated structure in which the wall structure may be a rigid molded structure.

In soft-sided insulated containers the main closure of the lid has tended to depend on the closing of a zipper, often a zipper running around three sides of a rectangle, with the fourth side being hinged. The lid may rest on a foam lip or bead. The point of a cooler (or, more generally, an insulated container) is to permit objects to be transported while retaining their cool, or warmth, to a greater extent than otherwise. At some point, however, the user may wish to retrieve the object, or objects. It may be that when retrieving objects, one may not wish to place those objects on the ground. One may wish for a work surface on which to place various objects, perhaps to assemble a sandwich or to prepare a mixed drink, or as a temporary surface for use while adjusting the contents of the container. It may also be desirable to have a work surface next to the thermally modified environment when one may hold or rest an object, without having to open the cooler or warmed chamber. That is, the more often and longer the cooler is opened or held open, the sooner it loses its potential for keeping objects cool (or, conversely, in the opposite context, warm). In either case, whatever other surfaces the assembly may have, it may be desirable for the cooler to open toward the temporary work surface.

With these thoughts in mind, referring now to FIGS. 1*a* to 3*f,* by way of general overview, a container or container assembly is identified as 20. Container assembly 20 includes an outer casing 22 in the nature of a soft-sided, insulated wall structure 24. Container assembly 20 has a first or main portion, 26, identified as a main body, 28, and a second portion identified as an auxiliary or secondary enclosure, 30, that is mounted to first portion 26.

First portion 26 may be generally box-shaped. That is, it may have a lower or main portion 32 and a closure member or lid portion 34. Lower portion 32 may include a base or bottom panel 36, and an upstanding peripheral sidewall 38 that includes four sides or side panels 40, 42, 44 and 46, being, respectively, front panel 40, rear panel 42, left hand side panel 44 and right hand side panel 46. Base or bottom panel 36, and the four side panels 40, 42, 44, and 46 may combine to form a five-sided open-topped box. A chamber 50 is defined within the box, and the respective upper margins of the sides co-operate to define a four-sided opening 48. In container assembly 20, each of panels 36, 40, 42, 44 and 46 may tend to be square or rectangular although this need not be so. For example the side panels could be trapezoidal such as to produce a box of tapering dimensions. Bottom panel 36 may tend to be rectangular, and may typically have two short sides, or edges, and two long sides or edges. The long edges may typically correspond to the front and back sides. The front and rear panels may tend to be the largest, or major, panels of the assembly. In some embodiments the front and back portions or sides or panels may be taller than wide. In the embodiment shown in FIGS. 1 to 4, the front and rear panels are slightly wider than tall, having an aspect ratio of about 8:7. In some embodiments, the capacity of chamber 50 may be 24 cans. By way of non-limiting example, a typical North American can may contain 355 mL of a beverage, and has dimensions of about 4¾" in height and 2⅜" in diameter. In another embodiment the capacity of chamber 50 may be 16 cans or 30 cans.

Lid portion 34 is of the same shape in plan view as the opening into which it fits. Lid portion 34 is hingedly attached along its rearward margin as at 52, and is movable between a first position in which it is closed, and impedes access to chamber 50, and an open position in which it is less obstructive of access to chamber 50. A lifting member such as a flexible handle or strap 54 may attach to the left and right hand sides 44, 46 to facilitate carrying. Container assembly 20 may also have external stretching mesh retainer pockets, which may be mounted to the left hand and right hand sides 44, 46 as illustrated at 56.

One or both of lower or first portion 26 and lid portion 34 may be made of a soft sided structure or panel, or web, or fabric that has an outer covering layer, and inner layer, and an insulation layer trapped between the inside and outside covering layers or skins. Bottom panel 36 may have an extra external covering, or an extra thick external layer, that may tend to be more durable or scuff-resistant.

Lid portion 34 may include a stiffened panel 60. Stiffened panel 60 may be overlain by an insulated layer of material. Alternatively, stiffened panel 60 may have an externally exposed surface 62. Externally exposed surface 62 may include a flat portion or region 64 upon which to place objects; and may also include a retainer 66, such as a raised peripheral rim 68 suitable for discouraging or limiting sliding of objects placed upon region 64. Other forms of retainer 66 may include cup holder rings or wells, or sockets. Stiffened panel 60 may also include an inside surface 70. The inside surface may be formed surface that includes a peripheral flange or channel or rim 72.

A substantially rigid liner 80 may be mounted within chamber 50. Liner 80 may have a peripheral land, or rim, that engages rim 72 in a releasable friction fit, sometimes referred to as a zipperless closure. Lid portion 34 may include a grip, or handle, or tab 74 which may be grasped to release the friction fit and to open lid portion 34. Tab 74 may also have first a hook-and-eye fabric fastener strip 76 on the underside thereof that engages a second, mating, hook-and-eye fabric fastener strip 78, that engagement tending to discourage accidental or inadvertent release of the friction fit of lid portion 34.

Second portion 30 may be considered to be an auxiliary portion. It may be mounted to the front or forward face of the front wall of first portion 26. Second portion 30 may have a front wall 82, a bottom wall 84, a left hand side wall 86, a right hand wall 88, and a top wall or panel or member 90. Second portion 30 may have an insulated wall structure in the same manner as first portion 26. However, in some embodiments it need not necessarily be insulated. Second portion 30 may have a closure member, which by be in the form of a tracked fastener such as a zipper 92 that extends about left hand, front, and right hand margins of top wall member 90. In this configuration, a major portion of front side 40 of first portion 26 also defines the rear wall of second portion 30.

Figure 3A:
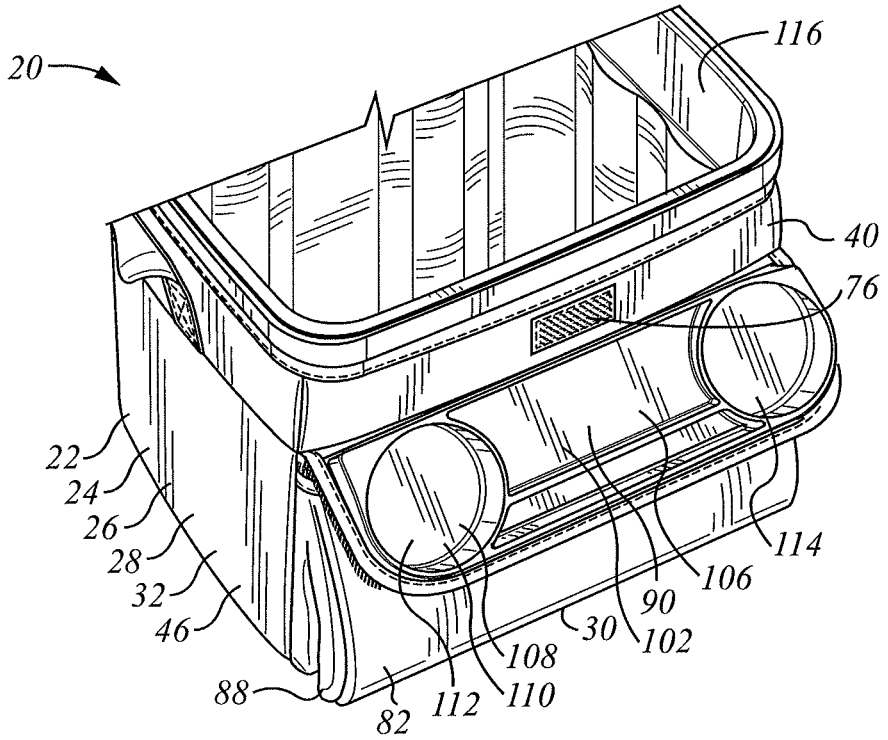
FIG. 3*a* shows a perspective view of the container assembly of FIG. 1*a* in a collapsed condition.
Figure 3B:
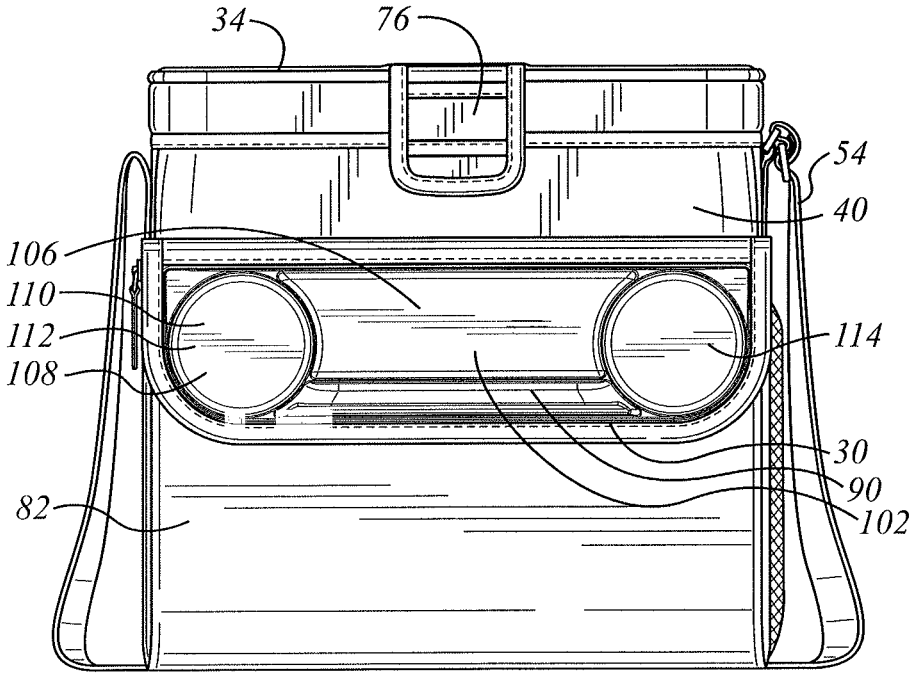
FIG. 3*b* shows a front view of the container assembly of FIG. 1*a* in a collapsed position.
Figure 3C:
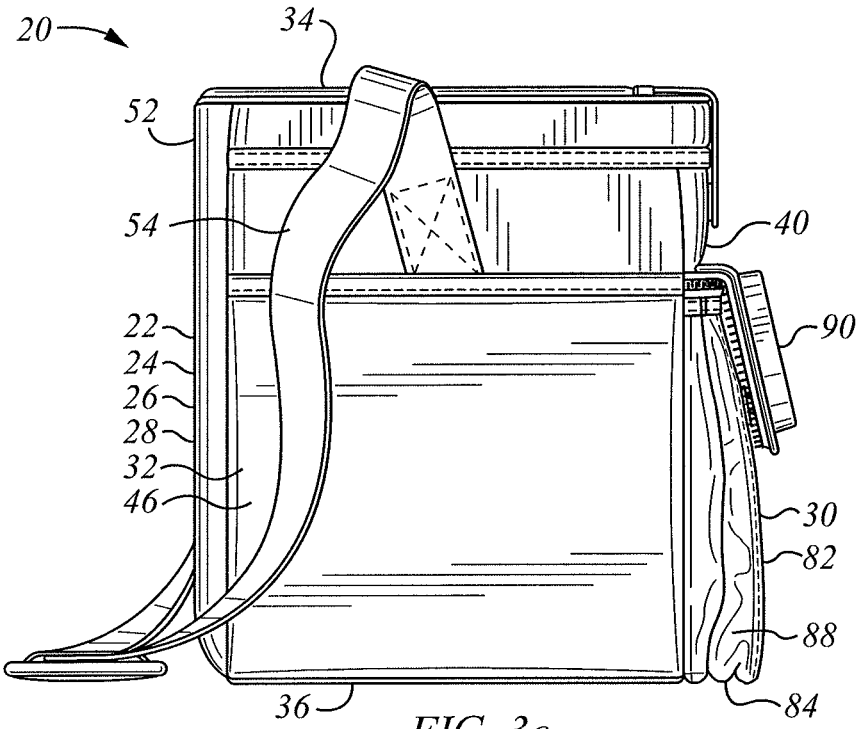
FIG. 3*c* shows a side view of the container assembly of FIG. 3*a;*

Second portion 30 may be collapsible from the deployed or extended position shown in FIG. 1*a* to 2*b,* in which top wall member 90 presents a predominantly upwardly facing orientation in which objects may be placed upon member 90; to a retracted, or folded, or collapsed, or storage position, as shown in FIGS. 3*a* to 3*c*. In the stored position, member 90 may be in a substantially or predominantly vertical orientation, or folded or angled downward and outwardly away, as opposed to a predominantly horizontal orientation.

Figure 3D:
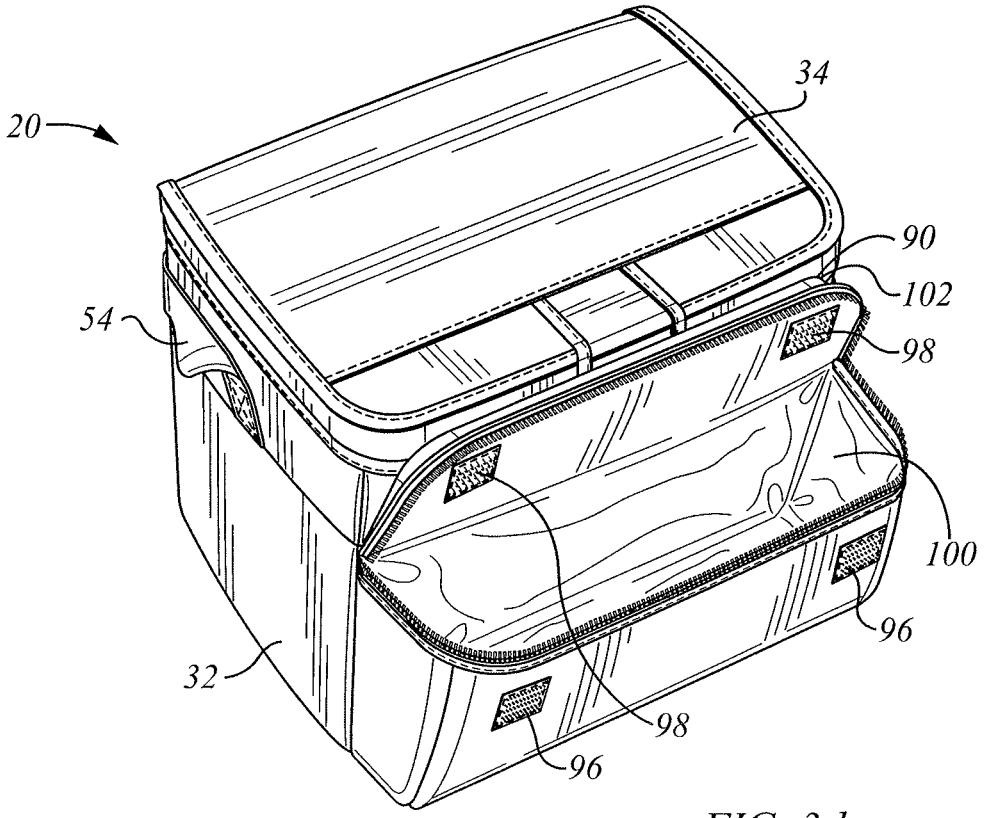
FIG. 3*d* shows a detailed view of the container assembly of FIG. 3*a* with a second container portion in an expanded and open position.

The left and right hand side walls 86, 88 and bottom 84 of second portion 30 may be foldable or folding members such as to permit front wall 82 to move backward toward front side 40 of first portion 26 in the collapsed position. A securement fitting, or fittings, 94 may be mounted to the front wall 82 for engagement with mating securement fittings 96 such as may be mounted on the underside of top wall member 30 (See FIG. 3*d*) near the lip of the cover. A closure member, such as a tracked closure member in the form of a zipper 98 may be mounted about the upper margins of walls 86, 88, and 90, releasably securing them to the corresponding opposed margins of member 30. Top wall 90 is then the lid or top the secondary chamber 100 defined within second portion 30, and governs access thereto. Top wall 90 is movable to a released, open position, as shown in FIG. 3*d*, such as may permit the entry or retrieval of objects; to a closed, deployed and secured position, as seen in FIG. 1*a;* and to a collapsed, secured position as seen in FIG. 3*a* in which securements 96 and 98 are engaged.

Figure 3E:
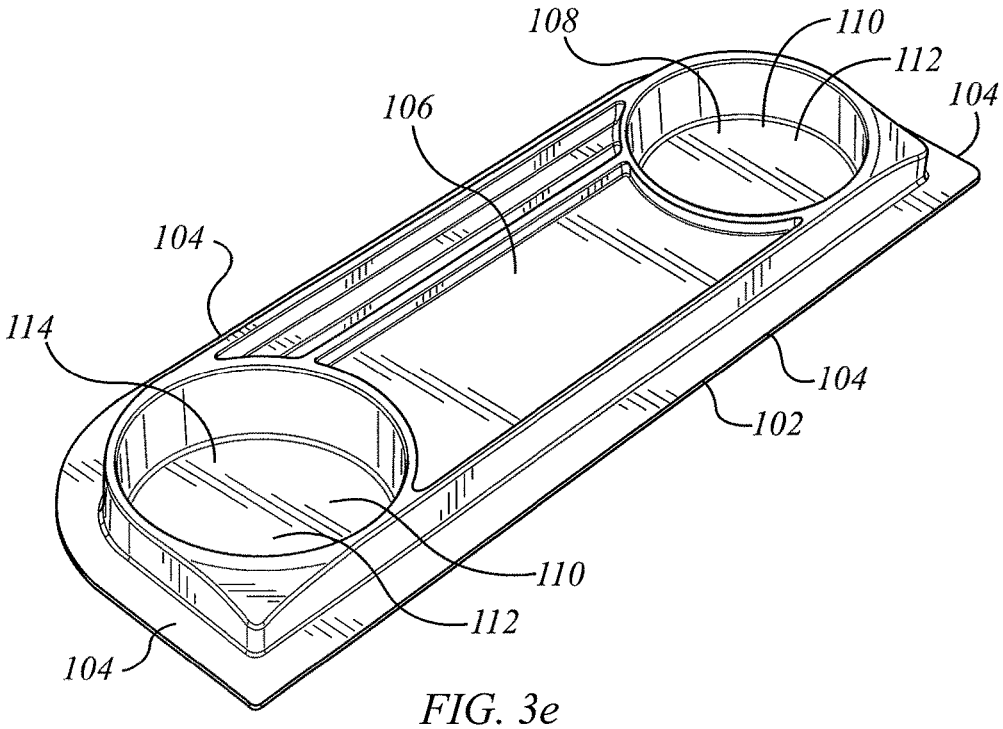
FIG. 3*e* shows a perspective view from above of a mid-height support element of the container assembly of FIG. 3*a;*
Figure 3F:
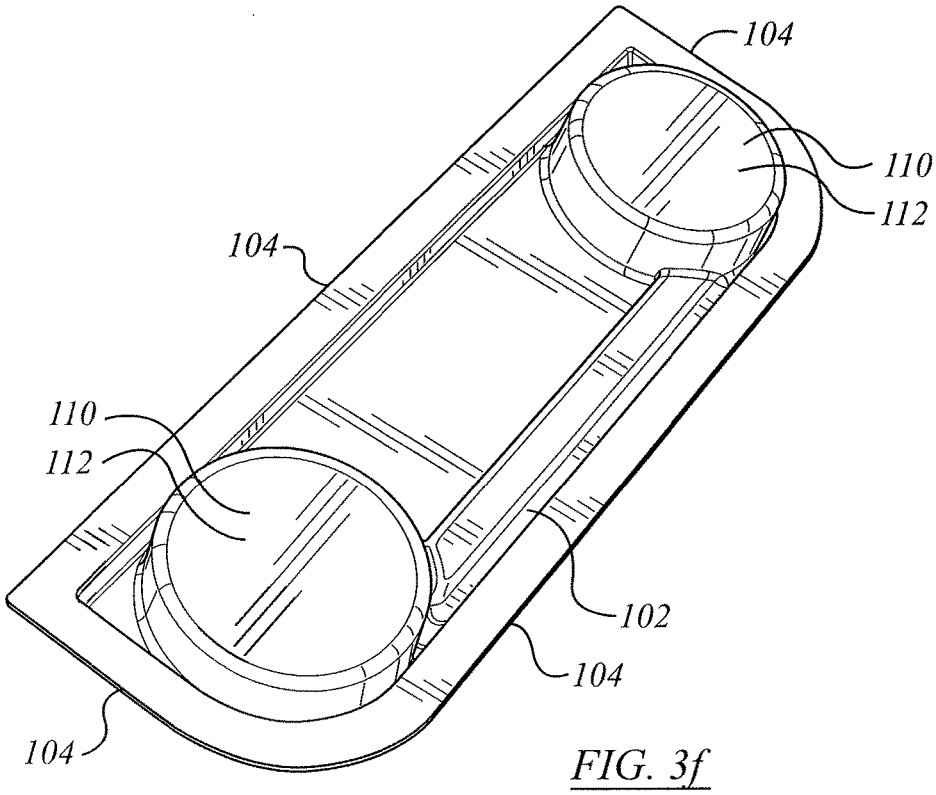
FIG. 3*f* shows an underside perspective view of the mid-height support element of FIG. 3*e;*

As seen in the detail of FIGS. 3*e* and 3*f*, member 90 may be made of a stiffened material such as a molded plastic. The material may include a peripheral lip or flange 102, such as may be generally horizontal, and may provide an engagement lend through which to pass stitching for attachment to the margins of the fabric wall materials. There may also be an out-of-plane upstanding peripheral wall, 104, such as may stand away from flange 102 and such as may be generally perpendicular thereto. Within the boundary of this wall, or retainer, there may be a first support, or supporting region, or surface, 106, such as may be substantially flat, and upon which one may rest an article. There may also be a second region 108 surrounded by a retainer or wall. Region 108 may have the form of a cup holder or beverage holder, however it may be termed. Region 108 may have the form of a socket or well, 110. The socket or well may have a depressed bottom or base wall 112 that protrudes downwardly below the level of flange 102, and may have an upstanding retaining wall that stands upwardly proud of flange 102, such that the socket has an overall depth that is greater than either the well or the upstanding wall alone. It may be that there is another region, a third region, 114, such as may also define a cup or beverage holder. Surface 106 may be located between regions 108 and 114.

In the deployed, closed condition, the plane of the top or lid, for which the plane of flange 102 may be taken as a proxy, may be angled slightly inwardly toward first portion 26. Top wall 90 may be located below the plane of the top of lid portion 34. It may be located sufficiently far below the lip that a beverage can sitting in one of the cup holder sockets may tend also to sit shy of the lip of lid portion 34. That is to say, the height difference $h_{90}$ from the lip of lid portion 34 to flange 102 may be greater than half the width of top wall 90, and may be of the approximately the same size, or somewhat larger as height difference $h_{90}$. Top member 90 may be located at the same, or approximately the same, height as the upper edge of stretch netting side members 56, which is to say roughly ⅔ to ¾ up the height of the side walls. The supporting member, or working surface, or beverage seat, or beverage storage receptacle, however the fittings may be called, provide a support surface forwardly and downwardly of the opening of the main container portion. The support may be termed a half-height or mid-height support. When the lid is closed, a drink or sandwich or other snack may rest on the support while the cooler remains closed; when the cooler is opened, the objects may be below, i.e., clear of, the plane of the opening, and so perhaps less likely to be bumped or knocked over. In the case of the well, the opening may be generally round, or in any case may have a major dimension that is suitable for a beverage can, and may be 2½ inches or more in diameter. The height from the bottom of the well to the plane of the opening may be 5 inches or more, such that a 4¾" tall can or cup may remain shy of, i.e. below, the plane of the opening.

Container assembly 20 may be a zipperless container. That is to say, the main lid closure is operated not by a zipper but rather by the interference fit of the lid in the associated land of the lower portion of the container. This friction fit is aided, or backed-up, or supplemented, by a second closure, 122 that has a protruding flexible engagement member 124 with a hook-and-eye fabric (e.g., Velcro t.m.) securement to the front face of the unit immediately below the rim of the receptacle and insulated casing, and immediately above secondary portion 30, where it is readily accessible for grasping by hand. When engaged, the fastener may tend to resist in shear the opening of the lid.

Container assembly 20 may have an internal liner 116, such as may be a hard plastic molding. The molding may have an upper peripheral edge that defines a hard land that is engaged by the hard internal molded framing member of the lid in an interference fit. Assembly 20 may also have removable support, or tray, or frame, such as may be identified as a shelf or shelving 118, and such as may also include breathing or draining apertures. In use, one may place objects to remain cool (or warm) on shelving 118, as a second layer, and perhaps as a layer such as may tend not to be damp from, for example melted ice water such as may collect in the bottom of the liner. Alternatively or additionally, a cooling element, such as an ice pack of, e.g., a frozen eutectic material or brine, or gel, may be placed on the tray, and so tend to cool the unit.

In use, a person may wish to retrieve an object, such as a cooled drink, from the lower well. Perhaps one has retrieved objects such as a paring knife and a cup from secondary enclosure chamber 100. Perhaps an object such as a lemon or lime is removed from shelving 118 and placed on surface 106 with the paring knife. Perhaps a cooling element is removed and placed to one side. Shelving 118 is removed, and placed to one side, perhaps supported on the up-turned inside of lid portion 34. Another object, perhaps a beverage, is drawn from the lower region of the well formerly under shelving 118. Maybe more than one such object is drawn out, such as might be suitable for mixing, and placed on shelving 118. The shelving and ice pack are replaced, and the lid is closed. The drink is mixed, the lime or lemon is sliced, and so on. The drink may then sit in the drink retainer while persons take their ease.

In the embodiment of FIGS. 1*a* through 3*f* top member 90 also acts as the lid of a secondary or auxiliary enclosure. This need not necessarily be so.

In the embodiment of FIGS. 4*a* through 7*b*, a soft-sided insulated container assembly is shown as 150. As before, container assembly 150 has a first, or lower portion 152, and a second or upper portion 154. The first or lower portion 152 may have the shape of an open topped box having an internal volume, or space, or chamber, or receptacle 156 , which may be substantially the same as or similar to chamber 50, surrounded by a base wall and upstanding sidewalls, which may be the same as, or substantially the same as items 36, 38, 40, 42, 44, and 46, described above. As before, the insulated wall structure may typically have an outside cover layer, an inside sheet or web, and a layer of thermal insulation between the inner and outer layers, such that the chamber or receptacle 156 may be an insulated space.

Figure 4A:
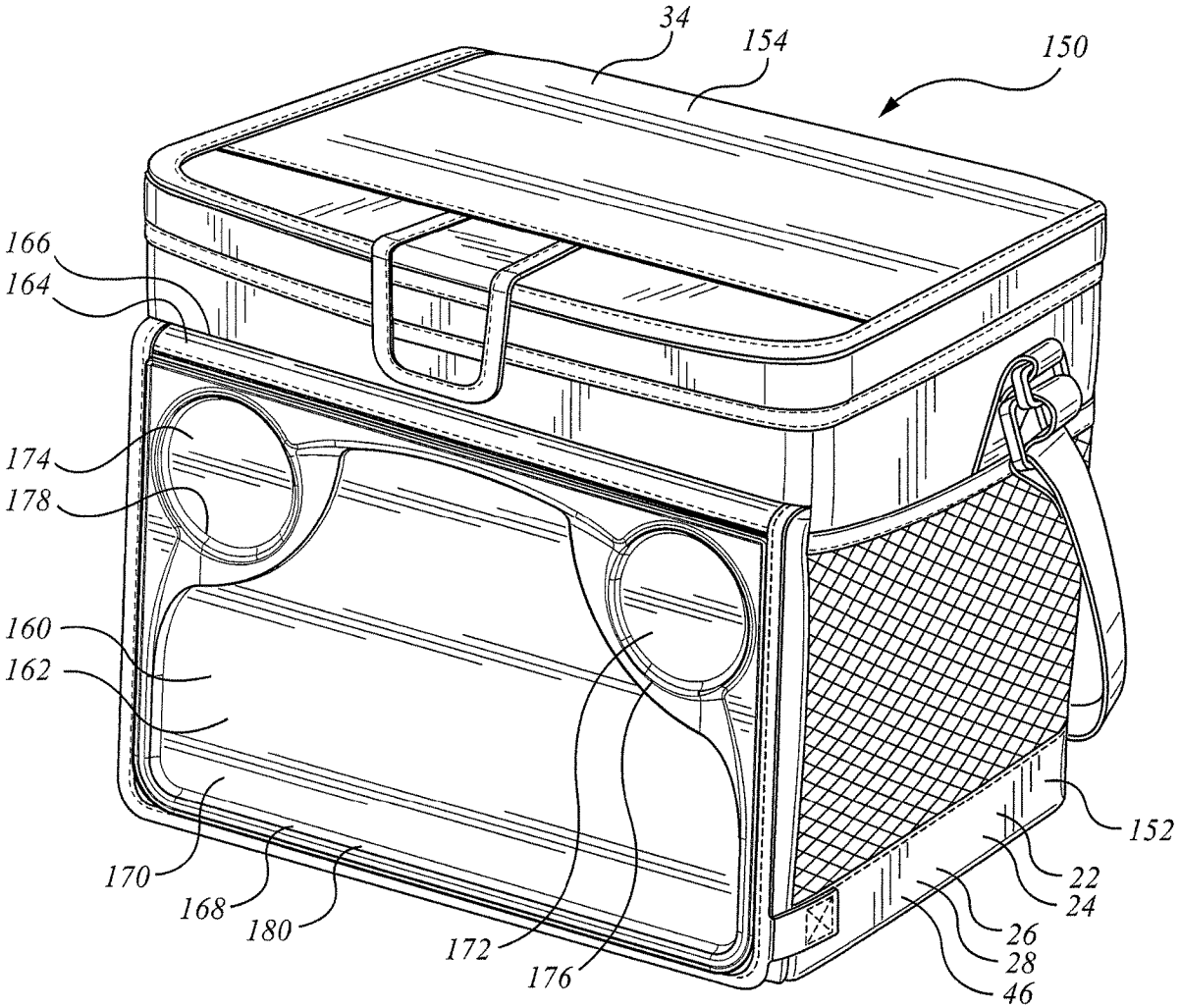
FIG. 4*a* is a perspective view of an alternate container assembly to that of FIG. 1*a* shown in a collapsed position.
Figure 4B:
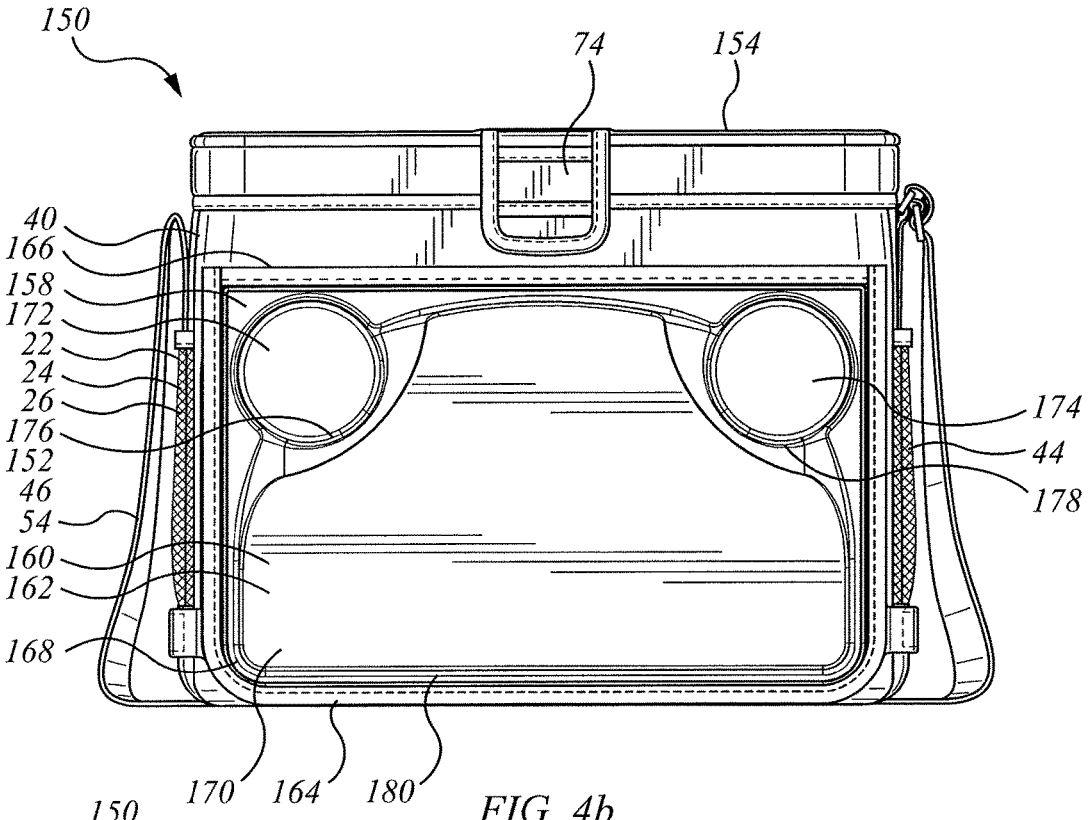
FIG. 4*b* is a front view of the container assembly of FIG. 4*a;*
Figure 4C:
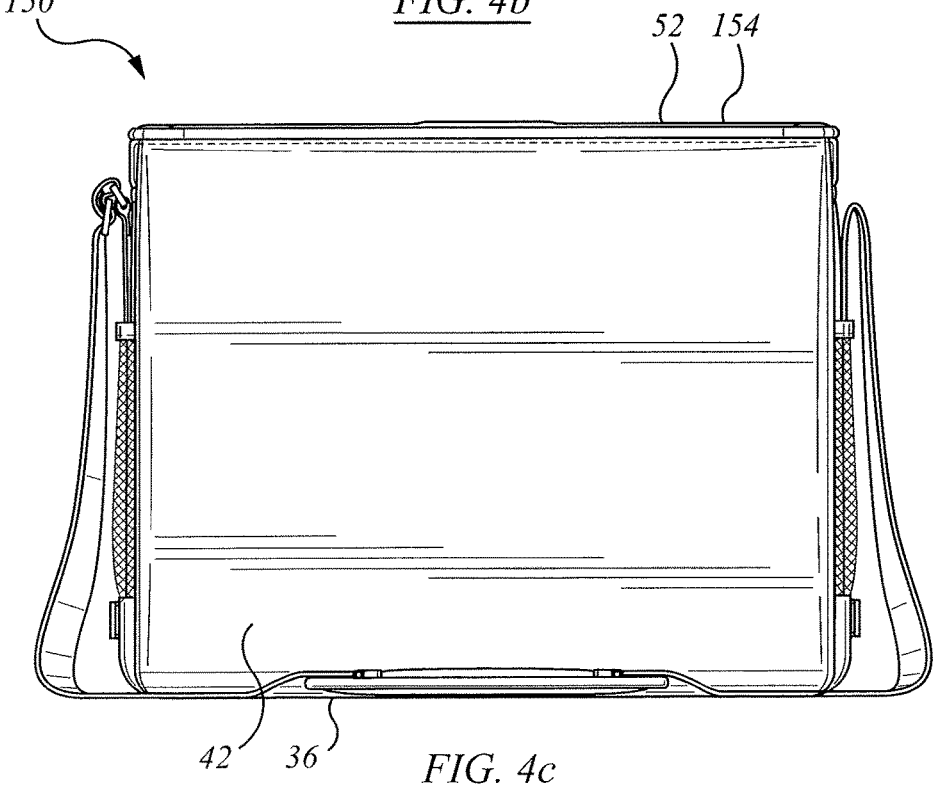
FIG. 4*c* is a rear view of the container assembly of FIG. 4*a;*
Figure 4D:
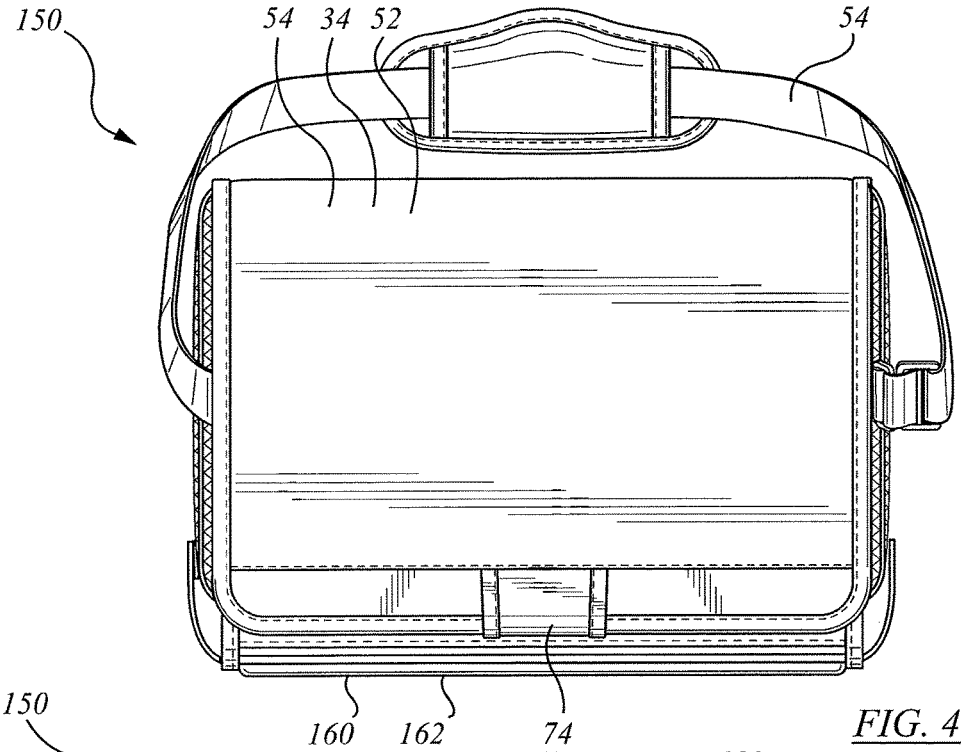
FIG. 4*d* is a top view of the container assembly of FIG. 4*a;*
Figure 4E:
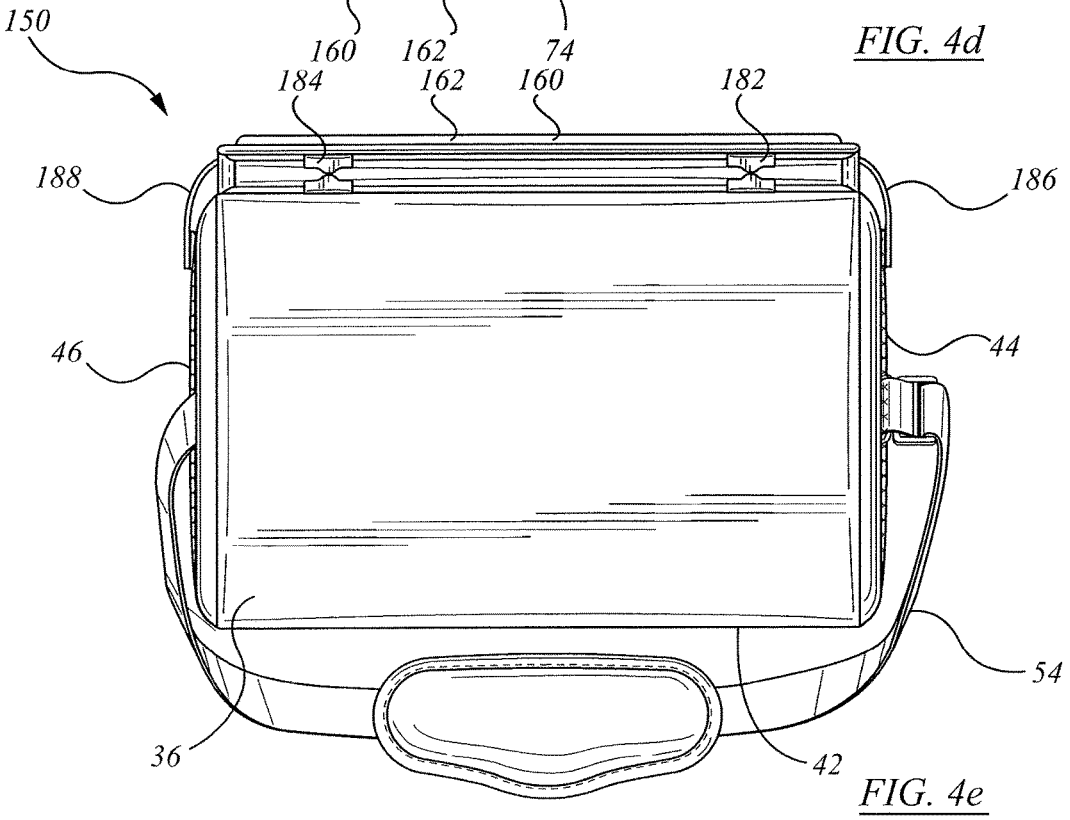
FIG. 4*e* is a bottom view of the container assembly of FIG. 4*a;*
Figure 4F:
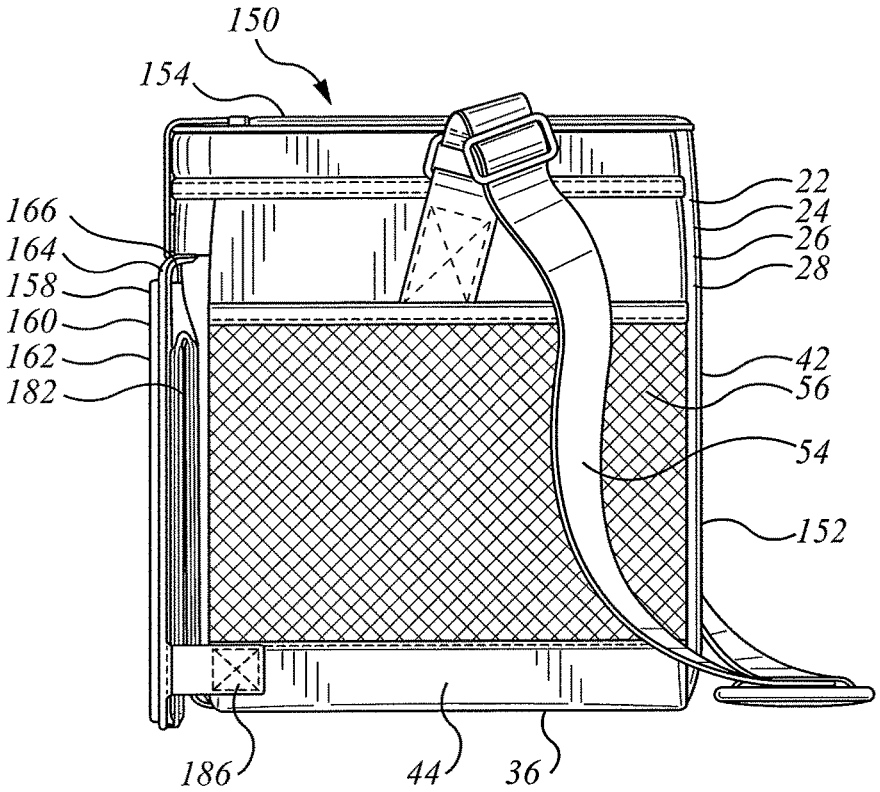
FIG. 4*f* is a left-hand view of the container assembly of FIG. 4*a;*
Figure 4G:
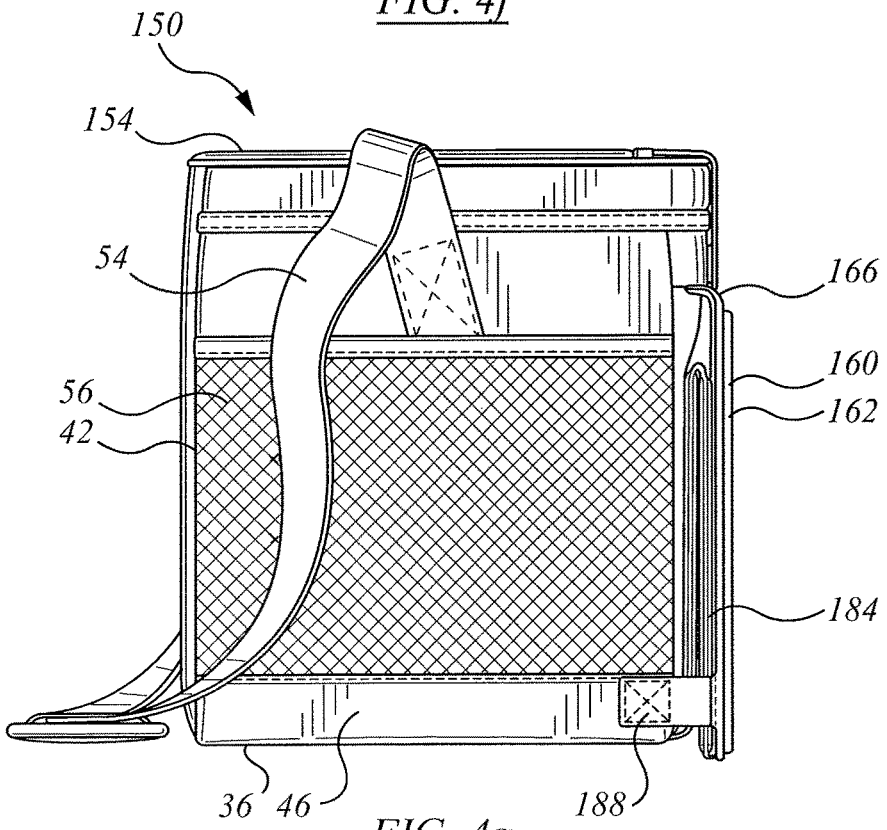
FIG. 4*g* is a right-hand view of the container assembly of FIG. 4*a;*
Figure 5A:
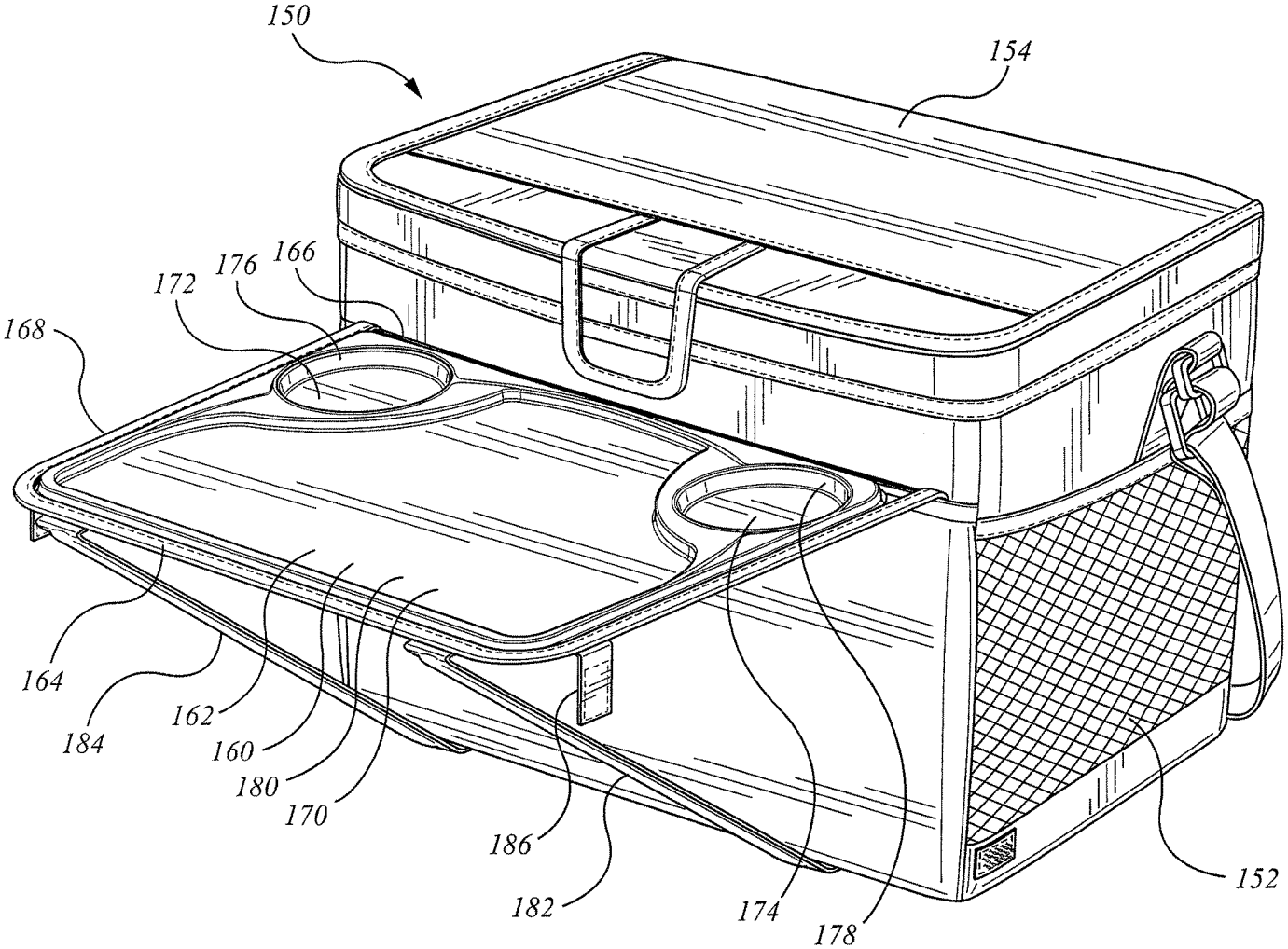
FIG. 5*a* is a perspective view from the right, front, and above, of the container assembly of FIG. 4*a* in a deployed position.
Figure 5B:
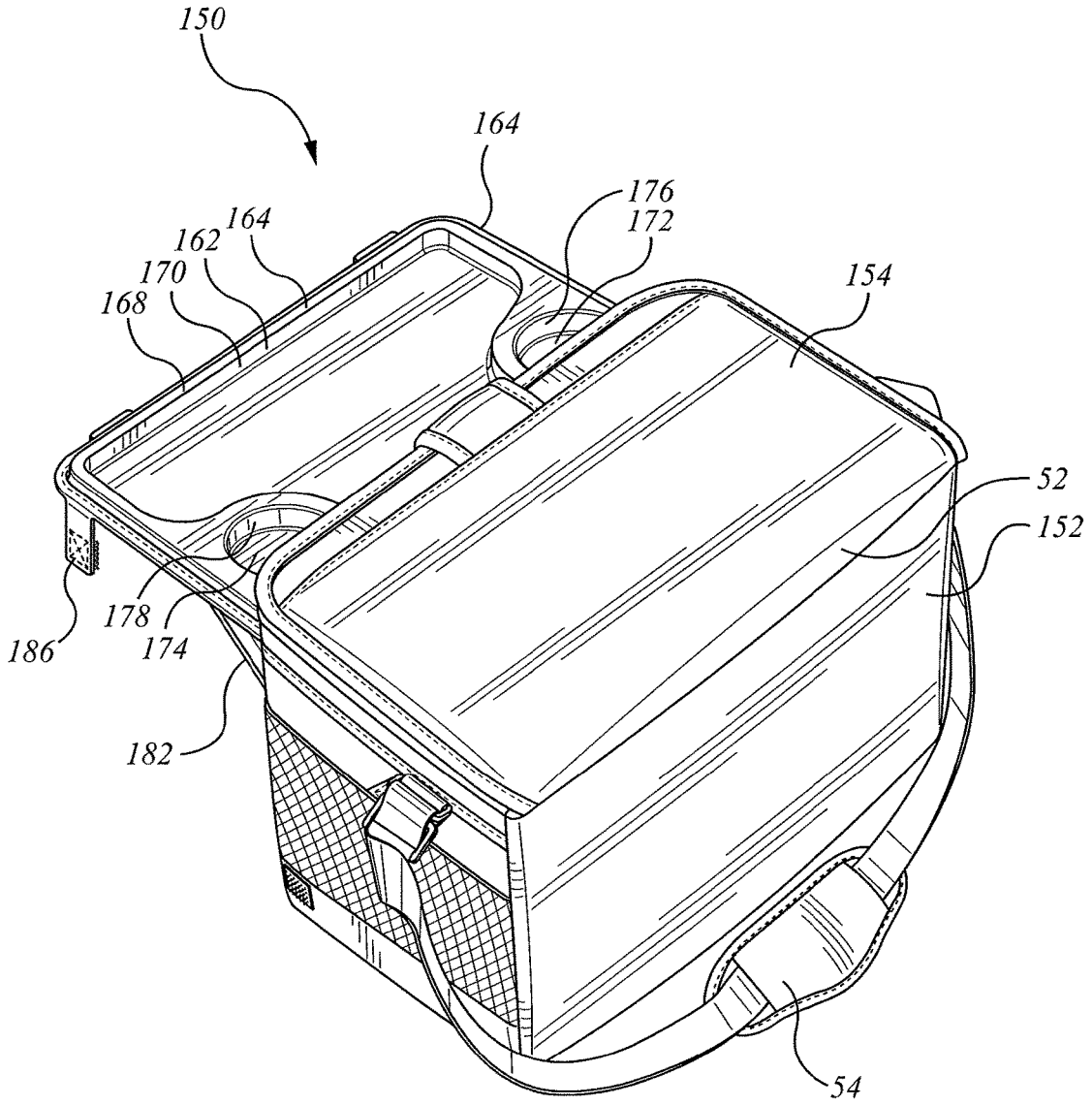
FIG. 5*b* is an opposite angle view from behind, left and rear of the container assembly of FIG. 5*a;*
Figure 5C:
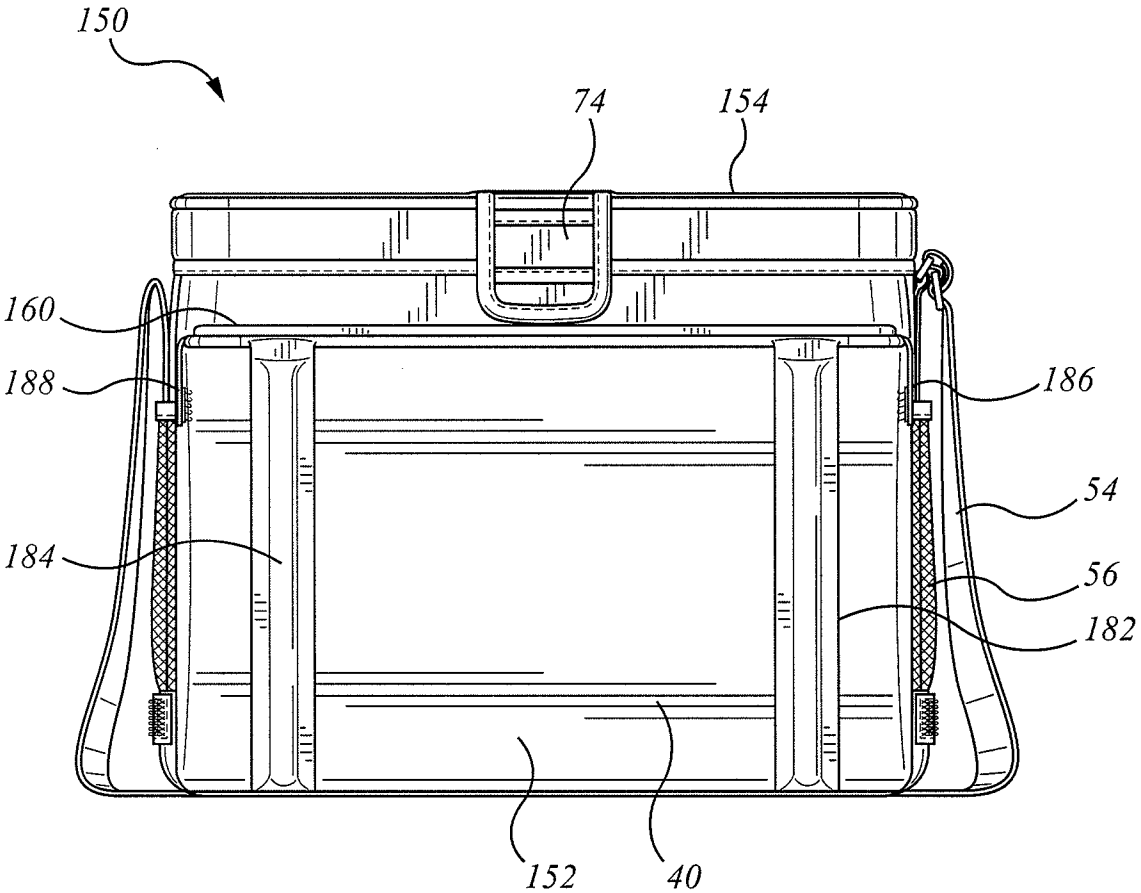
FIG. 5*c* is a front view of the container assembly of FIG. 5*a*, the rear view being the same as FIG. 4*c;*
Figure 5D:
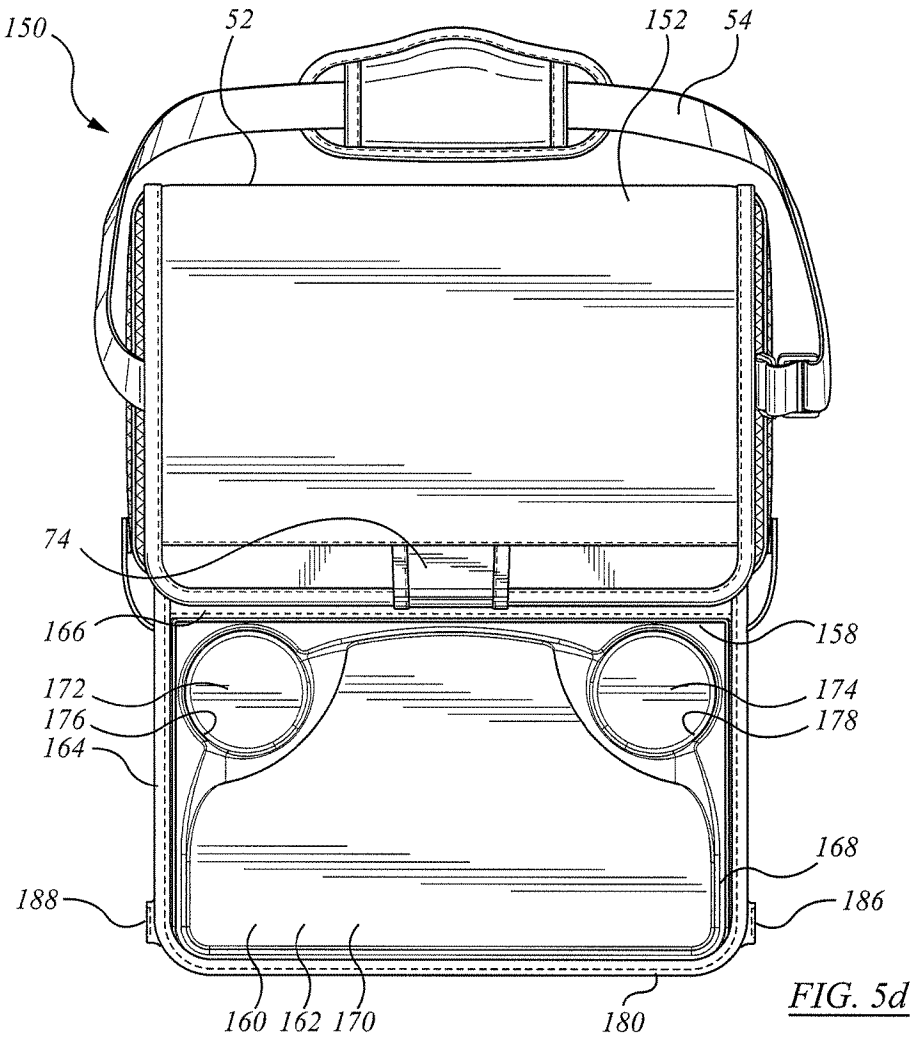
FIG. 5*d* is a top view of the container assembly of FIG. 5*a;*
Figure 5E:
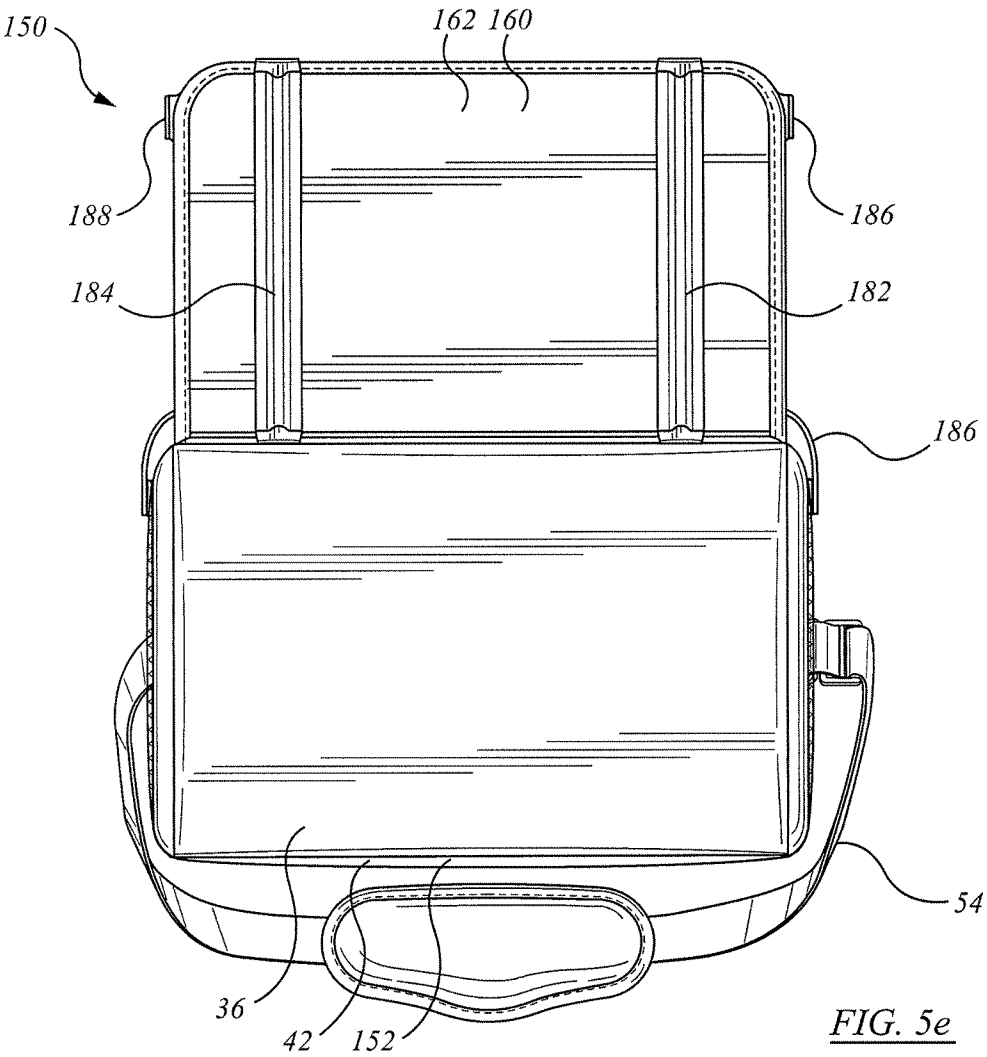
FIG. 5*e* is a bottom view of the container assembly of FIG. 5*a;*
Figure 5F:
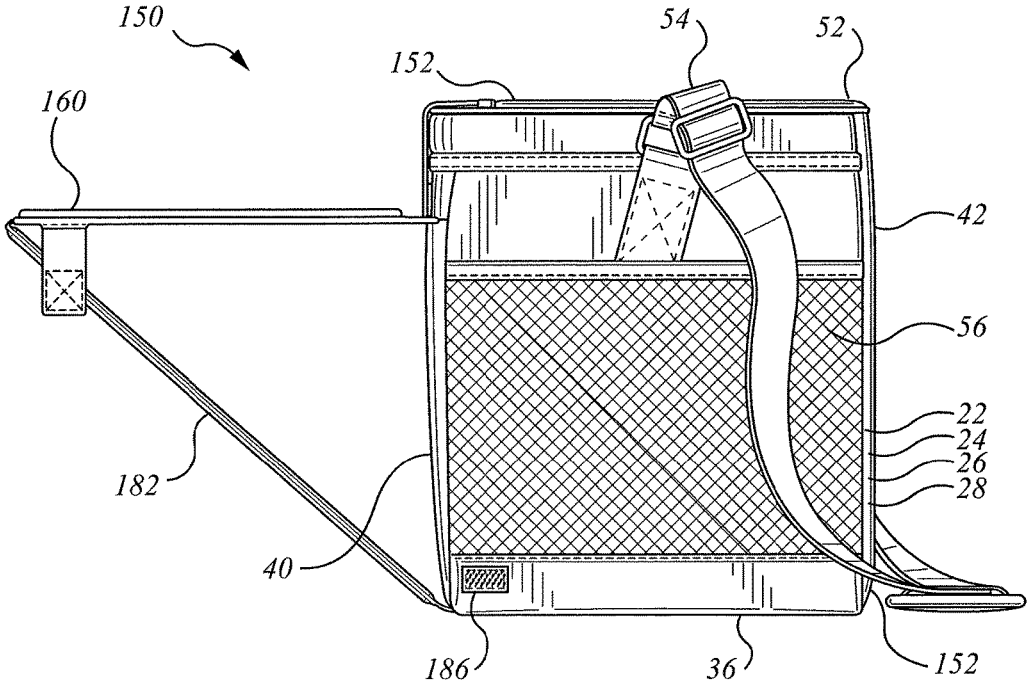
FIG. 5*f* is a left-hand view of the container assembly of FIG. 5*a;*
Figure 5G:
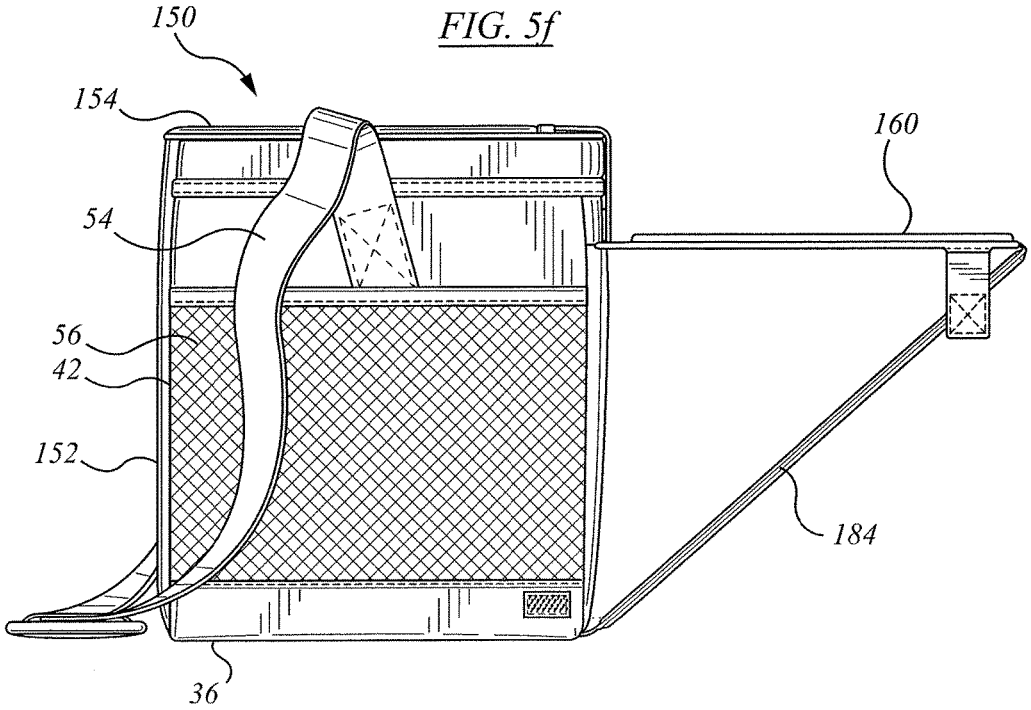
FIG. 5*g* is a right hand view of the container assembly of FIG. 5*a;*
Figure 6A:
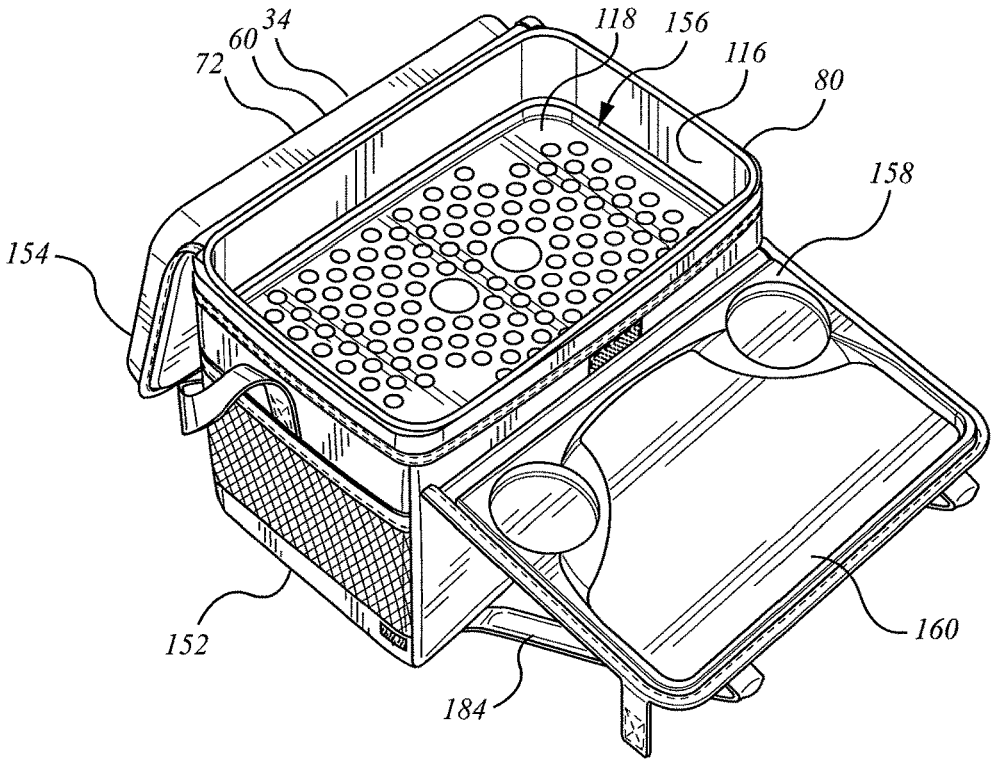
FIG. 6*a* is a perspective view of the container assembly of FIG. 5*a* in an open condition.
Figure 6B:
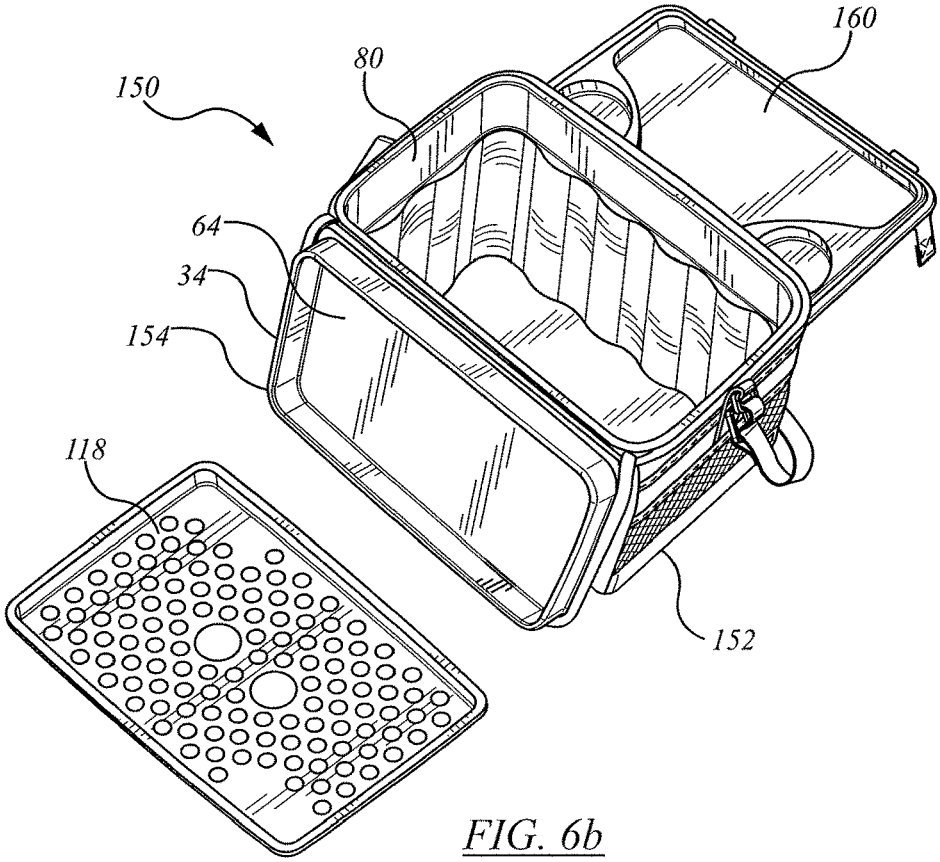
FIG. 6*b* is a perspective view of the container assembly of FIG. 6*a* with internal tray removed.
Figure 7A:
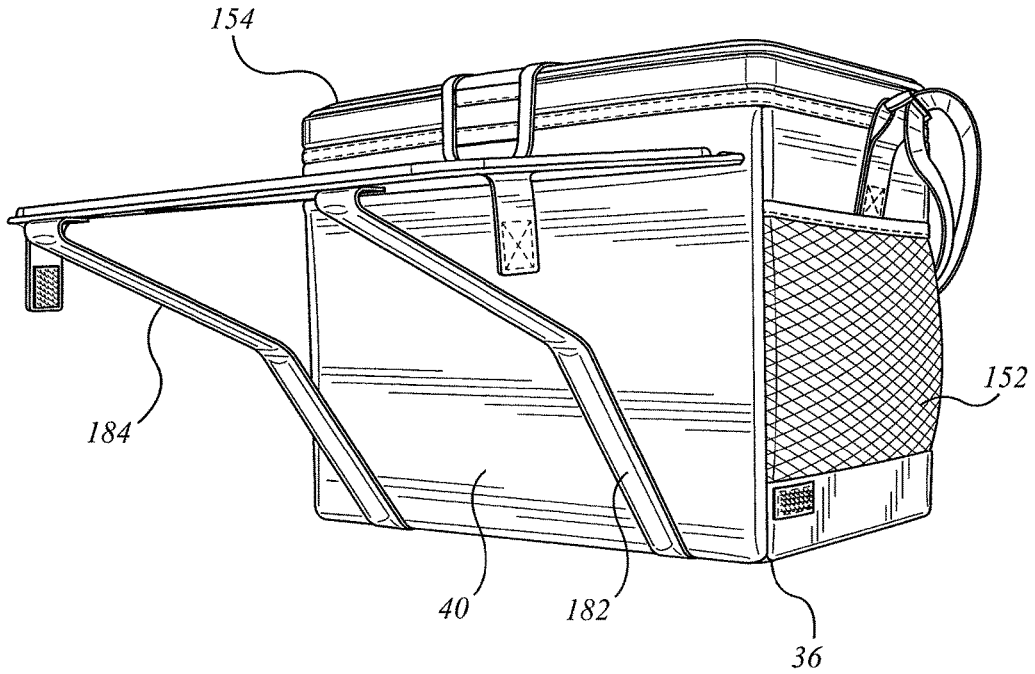
FIG. 7*a* is a perspective view from the front and to one side showing the collapsible struts of the container assembly in an intermediate condition.
Figure 7B:
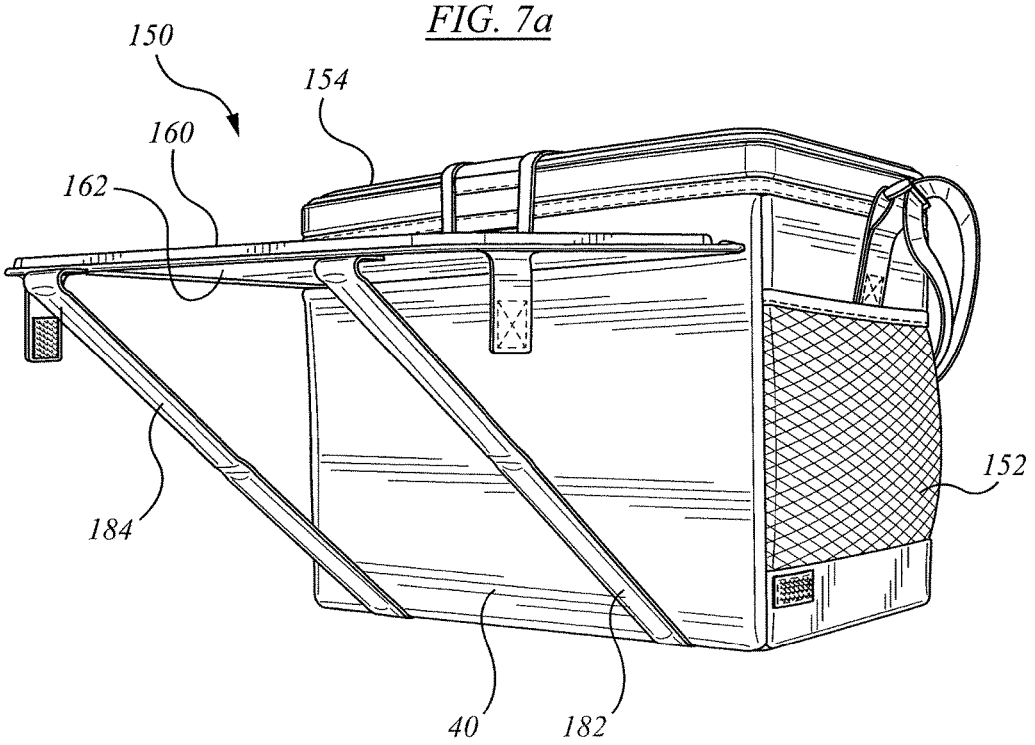
FIG. 7*b* is a view similar to FIG. 7*a* with the struts in the deployed condition.

Container assembly 150 may differ from container assembly 20 in that rather than having an enclosed secondary chamber located beneath a lower and forwardly extending support surface, container assembly 150 has a forwardly mounted table top assembly 160 that is movable from a folded, retracted, or collapsed position, as shown in FIG. 4*a*, to a raised, extended, or deployed position as shown in FIG. 5*a*. Unlike member 90, table top assembly 160 may not be associated with another storage compartment and may not be associated with governing access to such a compartment.

Table top assembly 160 may include a substantially rigid platform or surface, or substrate 162, which may be made of a substantially rigid molded plastic part. Substrate 162 may have an external peripheral flange or lip that is sewn into a connecting fabric member 164. The fabric member or fabric assembly may include a web or fabric hinge 166 that runs along the proximal margin 158 of substrate 162. Hinge 166 connects table top assembly 160 to the front side 40, and permits it to pivot from the predominantly vertical folded position to the horizontal, or predominantly horizontal and generally level deployed position for use.

Substrate 162 may include a peripheral retainer, which may be in the form of a retaining rim or wall, indicated generally as 168. The upper surface of the substrate 162 defines the table top, and may include a first region 170 that is substantially flat, upon which to place objects. A raised wall or ridge or lip such as wall 168 may extend peripherally about first region 170 to act as an obstacle to discourage sliding of objects off of region 170 where the placement of substrate 162 is not precisely level (e.g., as when container assembly 150 rests on ground that is not perfectly level). It may also include other support regions such as 172 and 174 that has raised peripheral retainers 176, 178, such as may be for discouraging the sliding of beverages and so on. Although other proportions could be used, table top assembly 160 may have a width corresponding substantially to the overall width of the main body 28 of container assembly 150. The length of table top assembly 160 from the proximal edge mated to front side 40 to the most distant part of distal edge 180 may correspond to the entire height measured from bottom panel 36 to immediately under the secondary lid securement member, 94. That is to say, the outward reach of table top assembly 160 may be substantially greater than the extent of top wall 90 of container assembly portion 30. That is, in the embodiment of FIG. 1*a* et seq., top wall 90 may define a relatively narrow shelf, that has a dominant or major axis or dimension in the width-wise direction $W_{90}$, and a minor axis or dimension in the outstanding lengthwise direction, $L_{90}$. In some embodiments the ratio of width $W_{90}$ across the unit to the extended distance $L_{90}$ forward of the unit when deployed is greater than 2½:1, and may be of the order of 3:1-4:1. By contrast, table top assembly 160 may have a width to depth ratio that is less than 2½:1, and may be of the order of 1½:1 to 2:1.

Table top assembly 160 may also include a support, a prop, an arm, or buttress, or an undercarriage. The undercarriage is movable from a retracted or storage position, as might be inferred from FIGS. 4*f*, 4*g*, and the partially extended view of FIG. 7*a*; to an expanded, extended, or deployed position as seen in FIGS. 5*a*, 5*c*, 5*e*, 5*f*, 5*g* and 7*b*. In the embodiment shown the undercarriage includes collapsible support members 182, 184 mounted between table assembly 160 and front side 40. Each support member 182, 184 may have a fist end anchored or otherwise mounted to a lower region of front side 40 (typically closely adjacent to, or at, the junction of front side 40 and bottom panel 36), and a second end anchored to the underside of table top substrate 162. The second end may be anchored more than half way out along substrate 162, and in some embodiments may be anchored at a pivot more than ⅔ along the span, and, in the embodiment shown, may be anchored near, at, or to, distal edge 180.

Each of supports 182, 184 may be have the form of a retracting strut, whether as a telescoping member or as a spring-loaded folding member, such as an over-center strut. In the embodiment shown, each member 182, 184 may include a spring having an arcuate cross, section, the spring being deflected to cause the cross-section to flatten and fold when it is collapsed. Container assembly 150 also includes table top storage securements, such as may fabric be hook-and-eye patch members 186, 188 on the left and right hand sides, respectively.

Figure 8:
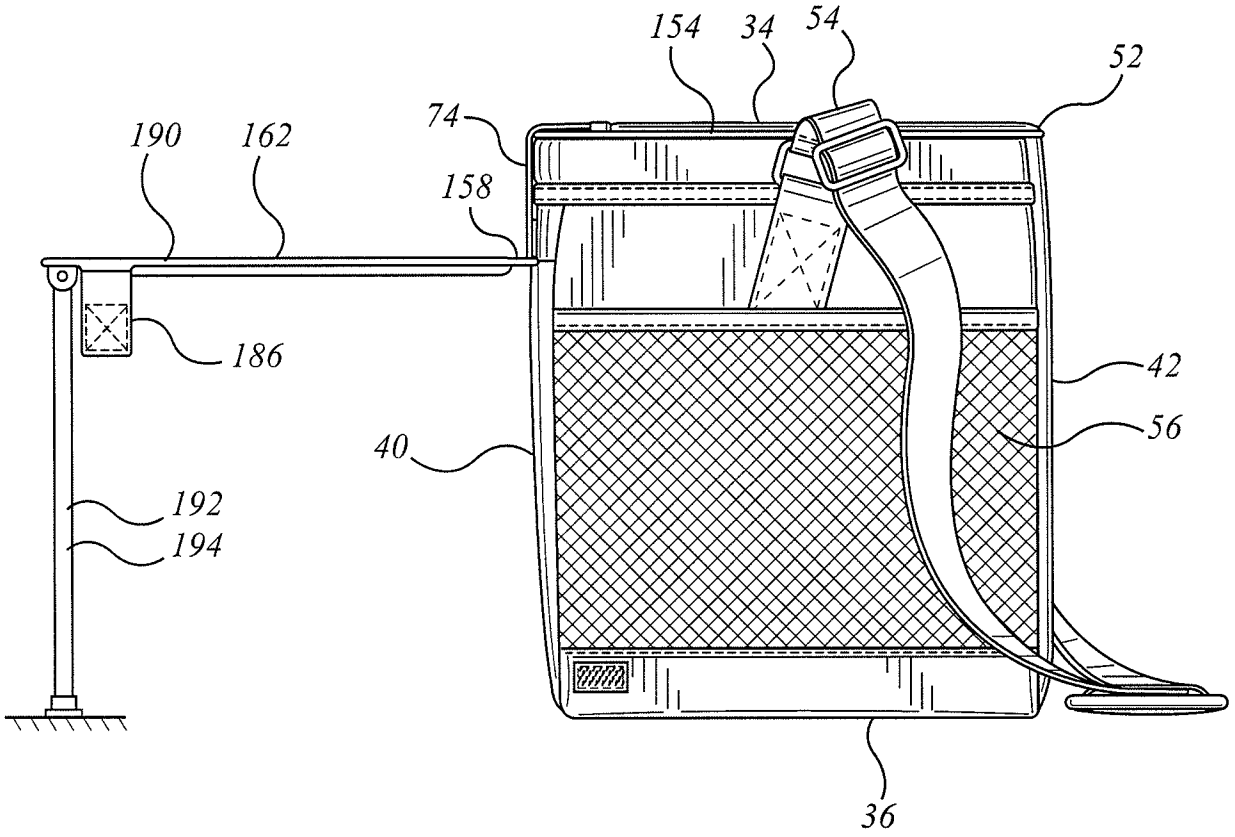
FIG. 8 shows a side view of an alternate embodiment of container assembly to that of FIG. 4*a;*

In an alternate embodiment shown in FIG. 8, a table top assembly 190 may be substantially the same as table top assembly 160, but differs therefrom in having a prop 192 in the form of a leg 194 pivotally connected to distal edge 180. There may be more than one leg 194. Leg, or legs, 194 may be a bi-pod with a single central mounting point along distal edge 180, or it may be a V-shaped support with a pair of spaced toes pivotally mounted to the underside of table top substrate 162, such as at or near margin 180, and a central ground-contact foot between them.

In a further alternate embodiment, prop 192 may be a telescoping straight leg that is extensible and has a releasable locking-screw member in the manner of a camera tripod leg.

Figure 9A:
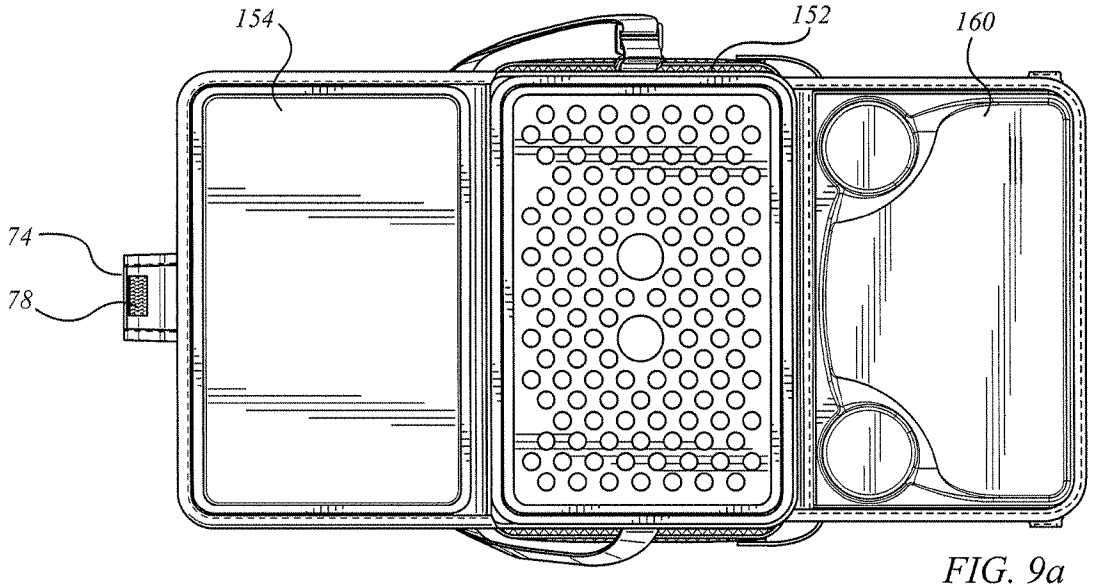
FIG. 9*a* shows another alternate embodiment of the container assembly of FIG. 4*a*, in a deployed condition with both a front flip up tray and a rearward opening lid deployed in a position to act as a working surface.
Figure 9B:
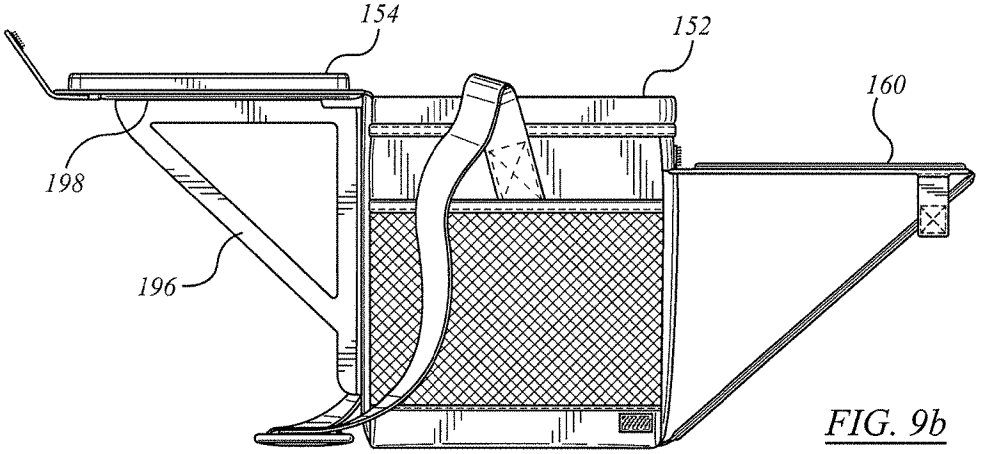
FIG. 9*b* shows a side view of the container assembly of FIG. 9*a*.

There may be occasions on which it may be desirable to limit the rotational displacement of lid portion 34 on opening. For example, it may be desirable that the lid open to a generally flat or horizontal posture, such that the inside of lid portion 34 may be used as a temporary support or shelf when re-arranging objects inside chamber 100. Alternatively, at generally open position the lid, having a deep peripheral rim 68, perhaps as deep as an inch or more, may provide a place in which to store a removed ice pack or shelving 118 even when not particularly level. To that end, as suggested in the side view of FIG. 9*b*, rear face or side 42 may be provided with a stiffener to which a drop-leaf support arm 196 may be pivotally mounted. The pivotal mounting may be by a plastic hinge. The upwardly extending outward rest 198 of support arm 196 may then underlie, limit the range of motion of, and hold up, lid portion 34 in the open position. There may, or course, be a single drop-leaf leg, or a pair of spaced drop leaf legs positioned to spread the load. While drop leaf legs are shown or suggested, other props, supports or struts, whether pivoting, telescoping, or collapsible, could be also used.

Figure 10:
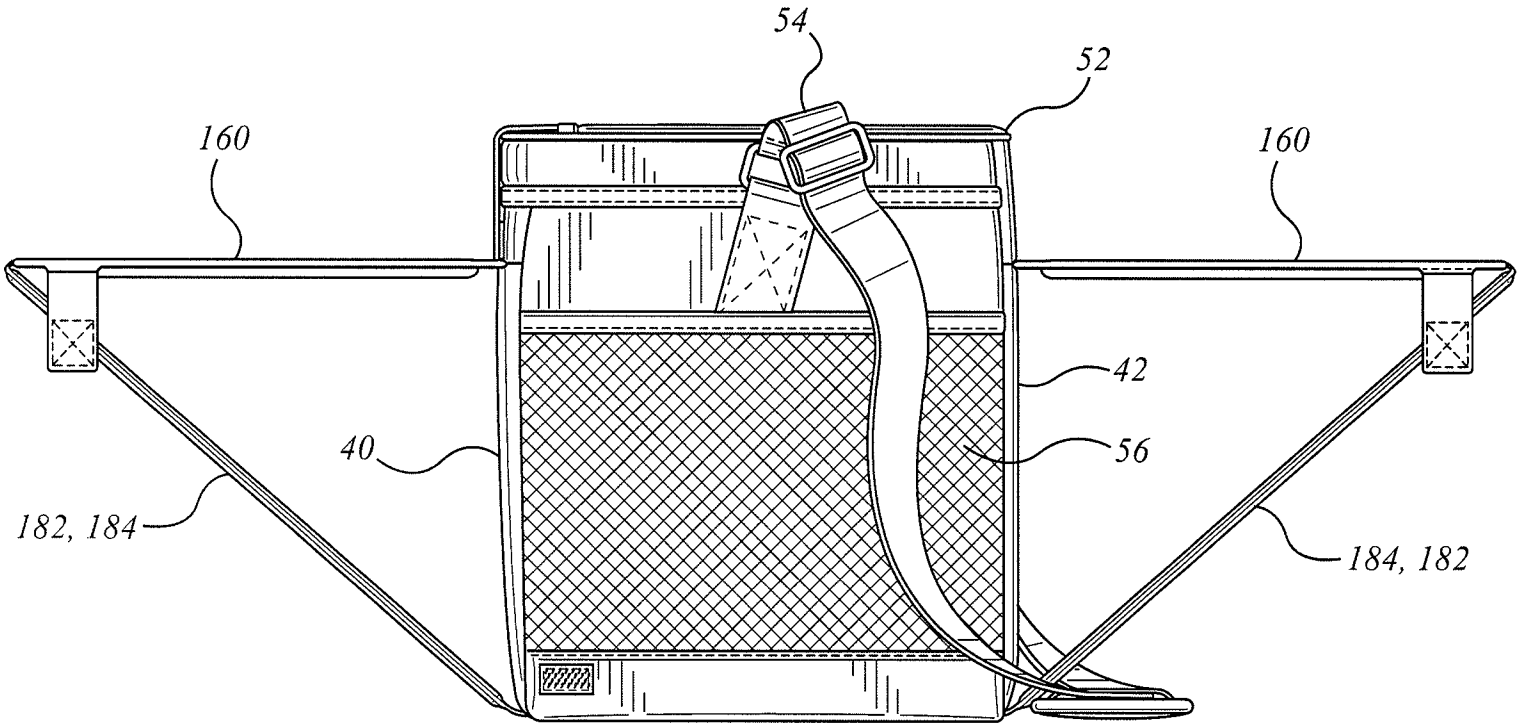
FIG. 10 shows a further alternative to the container assembly of FIG. 4*a*.

Alternatively, in the embodiment of FIG. 10, there may be times when it is desirable to have more than one work surface. To that end, a container assembly 200 has both a first table top assembly 160 mounted forwardly on front side 40; and a second table top assembly 210 mounted rearwardly on rear side 42. Table top assembly 210 may be the same in structure function and operation as flip-up table top assembly 160. Both assemblies 160 and 210 are shown as presenting their working or supporting surfaces at a level lower than the opening of chamber 50 and of lid portion 34, and in a position that allows lid portion 34 to open. Rearward assembly allows lid portion 34 to flip open and yet still be maintained at an angle permitting temporary placement of ice packs and shelving 118 within rim 68, as may be convenient.

In a still further alternative embodiment, a container assembly 200 such as generally shown and describes above, may combine a frontwardly positioned assembly such as secondary enclosure portion 30, including top wall 90, with a rearwardly positioned table top assembly, such as assembly 210.

Figure 11:
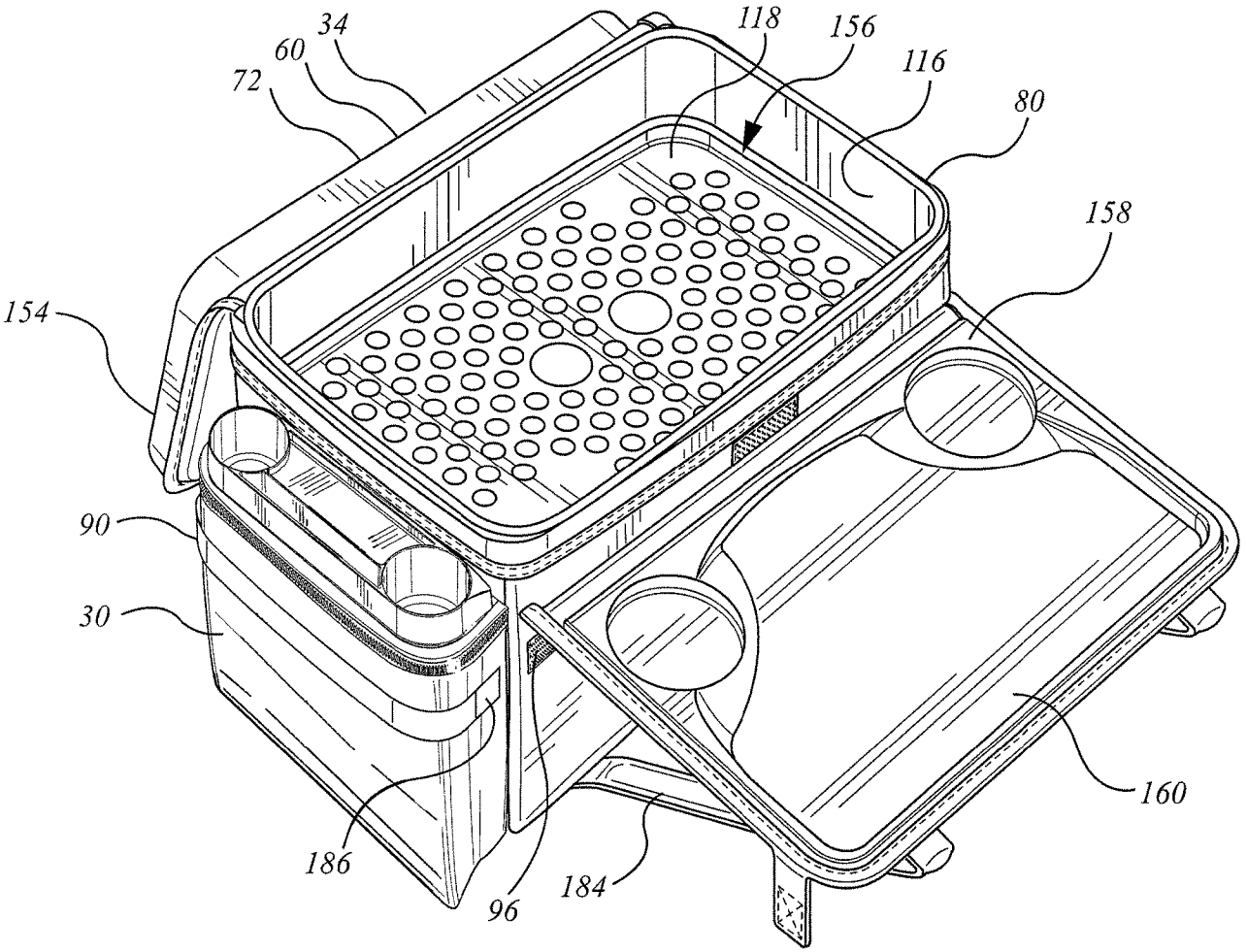
FIG. 11 shows a further alternative container assembly to that of FIGS. 1*a* and 4*a*.

In a still further alternative embodiment, such as shown in FIG. 11, a container assembly may be provided in substantially the same manner as container assembly 150, with a table top assembly 160 extending forwardly thereof at a depressed height relative to the opening, for example, while a secondary or auxiliary container portion similar to or substantially the same as collapsible second portion 30 including top wall 90 may be mounted to left hand side 44 or right hand side 46, in place of one or the other of expanding mesh pockets 56. In a further alternative, both mesh pockets may be supplanted by auxiliary enclosures of the nature of secondary enclosure 30, each with a collapsible support surface or member, such as top wall 90.

In such an embodiment, the left hand and right hand support surfaces may be the same, or then may be different. That is, they may each have the symmetrical layout of two drink holders with a central ledge or shelf, or each may have a single drink holder, such as near front side 40, and a shelf or ledge extending rearwardly thereof toward rear side 42, or some other arrangement of a flat shelf on one side, and drink or condiment holders on the other.

Although the various embodiments have been illustrated and described herein, the principles of the present invention are not limited to these specific examples which are given by way of illustration.

We claim:

1. A soft-sided insulated container comprising:

a first container portion, said first container portion having a soft-sided insulated wall structure defining an insulated chamber therewithin;

said insulated chamber having an upwardly facing opening;

said first container portion having a lid mounted thereto, said lid being movable between a closed position and an open position to govern access to said chamber;

said lid having a stiffened panel upon which to place objects when said lid is in said closed position, said lid being mounted to a rearward margin of said soft-sided insulated wall structure;

a second container portion mounted forwardly of said first container portion, said second container portion defining a second chamber in which to receive objects, said second container portion having a bottom, upstanding side-walls, a front wall, and a top;

said top of said second container portion including a substantially rigid work surface mounted to a forward region of said first portion of said soft-sided insulated wall structure distant from said rearward margin, said substantially rigid work surface being positioned clear of said opening and clear of said lid;

said substantially rigid work surface extending forwardly of said first container portion and facing predominantly upwardly to provide a support interface upon which to place objects; and said substantially rigid work surface being located downwardly shy of said opening;

said second container portion has a first position and a second position;

said second position of said second container portion corresponds to a collapsed position of said second container portion; and when both said first container portion and said second container portion are collapsed said lid of said first portion at least partially conceals said substantially rigid work surface.

2. The soft-sided insulated container of claim 1 wherein said substantially rigid work surface has a drink holder well defined therein.

3. The soft-sided insulated container of claim 2 wherein:

said substantially rigid surface is stepped downwardly from said opening by a first distance; said drink holder well has a depth of a second distance; and the sum of said first distance and said second distance is at least four inches; and said first distance is at least half as great as said second distance.

4. The soft-sided insulated container of claim 1 wherein said substantially rigid work surface of said second container portion is stepped downwardly relative to said opening of said insulated chamber of said first container portion.

5. The soft-sided insulated container of claim 4 wherein said substantially rigid work surface has a drink well.

6. The soft-sided insulated container of claim 5 wherein said drink well has an opening, said opening having a diameter; said drink well has a depth, said depth being at least half as great as said diameter; and said substantially rigid work surface of said second container portion being stepped downwardly of said opening of said first container portion by a step distance; and said step distance and said depth being, in sum, more than twice as great as said diameter of said drink well.

7. The soft-sided insulated container of claim 1 wherein said substantially rigid work surface of said second container portion extends forwardly away from said first container portion a first distance, and is stepped downwardly of said opening of said first container portion a second distance, said second distance being at least one third as great as said first distance.

8. A soft-sided insulated container comprising:

a first container portion, said first container portion having a soft-sided insulated wall structure defining an insulated chamber therewithin;

said insulated chamber having an upwardly facing opening;

said first container portion having a lid mounted thereto, said lid being movable between a closed position and an open position to govern access to said chamber;

said lid having a stiffened panel upon which to place objects when said lid is in said closed position;

said lid being mounted to a rearward margin of said soft-sided insulated wall structure;

a second container portion mounted forwardly of said first container portion, said second container portion defining a second chamber in which to receive objects, said second container portion having a bottom, upstanding side-walls, a front wall, and a top;

said top of said second container portion including a substantially rigid work surface mounted to a forward region of said first portion of said soft-sided insulated wall structure distant from said rearward margin, said substantially rigid work surface being positioned clear of said opening and clear of said lid;

said substantially rigid work surface extending forwardly of said first container portion and facing predominantly upwardly to provide a support interface upon which to place objects; and said substantially rigid work surface being located downwardly shy of said opening;

said first portion of said soft-sided insulated wall structure has a bottom wall and a four-sided peripheral wall standing predominantly upwardly from said bottom wall whereby to form an open-topped five-sided substantially box-shaped enclosure;

said lid defines a sixth side of said enclosure, and has a four-sided shape corresponding to said four-sided peripheral wall;

a first side of said four-sided peripheral wall defines a rear side of said first portion, said rear side having an upper margin distant from said bottom wall;

a second side of said four-sided peripheral walls defines a front side of said first portion, said front side of said first portion being opposite said rear side;

said lid is hingedly mounted to said upper margin of said rear side;

said second container portion being collapsible;

said substantially rigid work surface being hingedly connected to said front side of said first container portion along a margin that is stepped downwardly relative to said opening of said first container portion; and said first substantially rigid work surface having a retainer for discouraging motion of objects relative to said substantially rigid work surface.

9. The soft-sided container of claim 8 wherein:

said substantially rigid work surface is movable between a deployed position for supporting objects, and a storage position;

said container includes a second container portion mounted forwardly of said first container portion, said second container portion defining a second chamber in which to receive objects;

said substantially rigid work surface defining an upper wall of said second container portion;

said second container portion is collapsible and said storage position of said work surface corresponds to a collapsed position of said second container portion;

said retainer is a drink holder, said drink holder including a well that extends into said second container portion;

said substantially rigid surface is stepped downwardly from said opening by a first distance; said drink holder well has a depth of a second distance; and said first distance is at least half as great as said second distance.

10. The soft-sided insulated container of claim 8 wherein said substantially rigid work surface has a drink well.

11. The soft-sided insulated container of claim 10 wherein said drink well has an opening, said opening having a diameter; said drink well has a depth, said depth being at least half as great as said diameter; and said substantially rigid work surface of said second container portion being stepped downwardly of said opening of said first container portion by a step distance; and said step distance and said depth being, in sum, more than twice as great as said diameter of said drink well.

12. The soft-sided insulated container of claim 8 wherein said substantially rigid work surface of said second container portion extends forwardly away from said first container portion a first distance, and is stepped downwardly of said opening of said first container portion a second distance, said second distance being at least one third as great as said first distance.

13. A soft-sided insulated container comprising:

a first container portion and a second container portion;

said first container portion having a soft-sided insulated wall structure defining an insulated chamber therewithin;

said insulated chamber having an upwardly facing opening;

said first container portion having a lid mounted thereto, said lid being movable between an open position and a closed positon to govern access to said chamber;

said lid having a stiffened panel upon which to place objects when said is is in said closed position;

said first container portion of said soft-sided insulated wall structure having a front side and a rear side;

said lid being connected to said rear side of said first portion of said soft-sided insulated wall structure;

said second container portion being mounted to said front side of said soft-sided insulated wall structure of said first container portion;

said second container portion having a top wall member, a front wall member, a bottom wall member, a left hand side wall member and right hand side wall member;

said top wall member of said second container portion having a substantially rigid work surface;

said rigid work surface of said top wall of said second portion of said soft-sided insulated container being located forwardly of, and clear of, said upwardly facing opening of said soft-sided insulated container;

said soft-sided insulated wall structure of said first portion having a bottom wall and a four-sided peripheral wall standing predominantly upwardly from said bottom wall to form an open-topped five-sided substantially box-shaped enclosure;

said lid defining a sixth side of said enclosure, and having a four-sided shape corresponding to said four-sided peripheral wall;

a first side of said four-sided peripheral wall defining said rear side of said first portion, said rear side having an upper margin distant from said bottom wall;

a second side of said four-sided peripheral walls defining said front side of said first portion, said front side of said first portion being opposite said rear side;

said lid being hingedly mounted to said upper margin of said rear side;

said substantially rigid work surface defining an upper panel of said second container portion;

said second container portion having a lower wall structure that includes said front wall member, left hand side wall member, and right hand side wall member;

said second container portion having a tracked fastener closure member releasably connecting said upper panel of said second container portion to said lower wall structure of said second container portion;

said substantially rigid work surface being hingedly connected to said front side of said first container portion along a margin that is stepped downwardly relative to said opening of said first container portion; and said substantially rigid work surface having a retainer for discouraging motion of objects relative to said substantially rigid work surface.

14. The soft-sided insulated container of claim 13 wherein said top wall member of said second portion includes a stiffened moulded plastic material.

15. The soft-sided insulated container of claim 14 wherein said stiffened moulded plastic material of said top wall member has a peripheral flange, and has at least one drink holder socket formed therein.

16. The soft-sided insulated container of claim 13 wherein said substantially rigid work surface has a drink well.

17. The soft-sided insulated container of claim 16 wherein said drink well has an opening, said opening having a diameter; said drink well has a depth, said depth being at least half as great as said diameter; and said substantially rigid work surface of said second container portion being stepped downwardly of said opening of said first container portion by a step distance; and said step distance and said depth being, in sum, more than twice as great as said diameter of said drink well.

18. The soft-sided insulated container of claim 13 wherein said substantially rigid work surface of said second container portion extends forwardly away from said first container portion a first distance, and is stepped downwardly of said opening of said first container portion a second distance, said second distance being at least one third as great as said first distance.

19. The soft-sided insulated container of claim 13 wherein said second container portion has a closure member located below said top wall member, said closure member being operable to govern access to said second container portion.

20. A soft-sided insulated container comprising:

a first container portion and a second container portion;

said first container portion having a soft-sided insulated wall structure defining an insulated chamber therewithin;

said insulated chamber having an upwardly facing opening;

said first container portion having a lid mounted thereto, said lid being movable between an open position and a closed positon to govern access to said chamber;

said lid having a stiffened panel upon which to place objects when said lid is in said closed position;

said first container portion of said soft-sided insulated wall structure having a front side and a rear side;

said lid being connected to said rear side of said first portion of said soft-sided insulated wall structure;

said second container portion being mounted to said front side of said soft-sided insulated wall structure of said first container portion;

said second container portion having a top wall member, a front wall member, a bottom wall member, a left hand side wall member and a right hand side wall member;

said top wall member of said second container portion having a substantially rigid work surface;

said rigid work surface of said top wall of said second portion of said soft-sided insulated container being located forwardly of, and clear of, said upwardly facing opening of said soft-sided insulated container;

said second container portion has a closure member located below said top wall member;

said closure member being operable to govern access to said second container portion;

said front wall member of said second container portion is distant from said front side of said first container portion;

said front wall member of said second container portion has an upper margin;

said top wall member of said second container portion has a forward margin; and said closure member is a tracked fastener that releasably joins said forward margin of said top wall member to said upper margin of said front wall member.

21. The soft-sided insulated container of claim 20 wherein said substantially rigid work surface of said second container portion is stepped downwardly relative to said opening of said insulated chamber of said first container portion.

22. The soft-sided insulated container of claim 21 wherein said substantially rigid work surface has a drink well.

23. The soft-sided insulated container of claim 22 wherein said drink well has an opening, said opening having a diameter; said drink well has a depth, said depth being at least half as great as said diameter; and said substantially rigid work surface of said second container portion being stepped downwardly of said opening of said first container portion by a step distance; and said step distance and said depth being, in sum, more than twice as great as said diameter of said drink well.

24. The soft-sided insulated container of claim 20 wherein said substantially rigid work surface of said second container portion extends forwardly away from said first container portion a first distance, and is stepped downwardly of said opening of said first container portion a second distance, said second distance being at least one third as great as said first distance.

25. The soft-sided insulated container of claim 20 wherein said top wall member of said second portion includes a stiffened moulded plastic material.

26. The soft-sided insulated container of claim 25 wherein said stiffened moulded plastic material of said top wall member has a peripheral flange, and has at least one drink holder socket formed therein.

27. A soft-sided insulated container comprising:

a first container portion and a second container portion;

said first container portion having a soft-sided insulated wall structure defining an insulated chamber therewithin;

said insulated chamber having an upwardly facing opening;

said first container portion having a lid mounted thereto, said lid being movable between an open position and a closed positon to govern access to said chamber;

said lid having a stiffened panel upon which to place objects when said lid is in said closed position;

said first container portion of said soft-sided insulated wall structure having a front side and a rear side;

said lid being connected to said rear side of said first portion of said soft-sided insulated wall structure;

said second container portion being mounted to said front side of said soft-sided insulated wall structure of said first container portion;

said second container portion having a top wall member, a front wall member, a bottom wall member, a left hand side wall member and right hand side wall member;

said top wall member of said second container portion having a substantially rigid work surface;

said rigid work surface of said top wall of said second portion of said soft-sided insulated container being located forwardly of, and clear of, said upwardly facing opening of said soft-sided insulated container;

said substantially rigid work surface of said second container portion extends forwardly away from said first container portion a first distance, and is stepped downwardly of said opening of said first container portion a second distance, said second distance being at least one third as great as said first distance;

said top wall member of said second portion includes a stiffened moulded plastic material;

said stiffened moulded plastic material of said top wall member has a peripheral flange, and has at least one drink holder socket formed therein;

said second container portion has a closure member located below said top wall member, said closure member being operable to govern access to said second container portion;

said second container portion includes an upstanding wall member that has an upper peripheral margin;

said top wall member of said second container portion has a peripheral margin that mates with said peripheral margin of said forward margin;

said closure member is a tracked fastener that releasably joins said peripheral margin of said top wall member to said peripheral margin of said upper margin of said upstanding wall member of said second container portion.

28. The soft-sided insulated container of claim 27 wherein said first container portion is collapsible.

* * * * *